US012560030B2

(12) United States Patent
Trunk et al.

(10) Patent No.: US 12,560,030 B2
(45) Date of Patent: Feb. 24, 2026

(54) CENTRALLY LOCATED DRILL BIT CLEANING ELEMENT

(71) Applicant: Schlumberger Technology Corporation, Sugar Land, TX (US)

(72) Inventors: Philip Trunk, Houston, TX (US); Ming Zhang, Spring, TX (US); Mahesha Kumar, Cypress, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/408,805

(22) Filed: Jan. 10, 2024

(65) Prior Publication Data

US 2025/0223873 A1 Jul. 10, 2025

(51) Int. Cl.
*E21B 10/61* (2006.01)
*E21B 10/60* (2006.01)

(52) U.S. Cl.
CPC ..... *E21B 10/61* (2013.01); *E21B 10/602* (2013.01)

(58) Field of Classification Search
CPC ..... E21B 10/60; E21B 10/602; E21B 10/605; E21B 10/61
See application file for complete search history.

(56) References Cited

U.S. PATENT DOCUMENTS 2,098,758 A * 11/1937 Reed ..... E21B 10/10 175/376
2,976,944 A 3/1961 Bassinger
3,070,182 A * 12/1962 Runte ..... E21B 10/18 175/339
4,106,577 A * 8/1978 Summers ..... E21B 10/18 175/67
4,303,136 A * 12/1981 Ball ..... E21B 10/61 175/429

(Continued)

FOREIGN PATENT DOCUMENTS

CN 101942967 A 1/2011
CN 203603768 U 5/2014

(Continued)

OTHER PUBLICATIONS

Radford et al., Durable Bit Coating Reduces Shale Balling in Field Tests and Contributes to Longer Runs, SPE-173113-MS, paper presented at the SPE/IADC Drilling Conference and Exhibition, London, England, UK, Mar. 2015.

(Continued)

*Primary Examiner* — Robert E Fuller
(74) *Attorney, Agent, or Firm* — Jeffrey D. Frantz

(57) ABSTRACT

A downhole tool includes a body having a longitudinal axis and a fluid passage extending through the body. The downhole tool includes at least one blade having one or more engagement faces thereon. At least one junk slot extends adjacent to the at least one blade. The downhole tool includes a cleaning element at the longitudinal axis of the body. The cleaning element has a substrate bore in fluid communication with the fluid passage. The cleaning element includes at least one opening or passing a fluid from the substrate bore and out of the downhole tool through the at least one junk slot. A flow direction of the at least one opening is offset from the longitudinal axis.

22 Claims, 26 Drawing Sheets

(56) References Cited

U.S. PATENT DOCUMENTS

| | | | | |
|---|---|---|---|---|
| 4,452,324 | A * | 6/1984 | Jurgens | E21B 10/602 299/81.3 |
| 4,606,418 | A * | 8/1986 | Thompson | E21B 10/61 175/339 |
| 4,723,612 | A * | 2/1988 | Hicks | E21B 10/60 175/429 |
| 4,739,845 | A * | 4/1988 | Dennis | E21B 10/61 175/393 |
| 4,852,671 | A * | 8/1989 | Southland | E21B 10/60 175/430 |
| 5,316,095 | A * | 5/1994 | Tibbitts | E21B 10/61 175/429 |
| 5,579,855 | A * | 12/1996 | Dickey | E21B 10/18 175/393 |
| 6,164,394 | A * | 12/2000 | Mensa-Wilmot | E21B 10/567 175/431 |
| 6,581,702 | B2 * | 6/2003 | Dickey | E21B 10/18 175/339 |
| 6,986,297 | B2 * | 1/2006 | Scott | E21B 10/61 76/DIG. 11 |
| 9,551,191 | B2 | 1/2017 | Patel | |
| 10,337,257 | B2 | 7/2019 | Zhang | |
| 10,954,722 | B2 * | 3/2021 | Bradford, III | E21B 10/602 |
| 11,988,046 | B1 * | 5/2024 | Borissov | E21B 4/02 |
| 2002/0112889 | A1 * | 8/2002 | Larsen | E21B 10/18 175/57 |
| 2003/0019333 | A1 | 1/2003 | Scott | |
| 2004/0069540 | A1 * | 4/2004 | Kriesels | E21B 10/38 175/393 |
| 2007/0125580 | A1 | 6/2007 | Hall | |
| 2007/0163811 | A1 * | 7/2007 | Gutmark | E21B 10/61 175/393 |
| 2011/0031029 | A1 | 2/2011 | Gavia | |
| 2011/0266071 | A1 | 11/2011 | Lind | |
| 2015/0136490 | A1 | 5/2015 | Broussard, Jr. | |
| 2015/0267492 | A1 * | 9/2015 | Broussard, Jr. | E21B 10/04 175/107 |
| 2015/0368976 | A1 * | 12/2015 | Langford | E21B 10/605 175/57 |
| 2016/0076309 | A1 * | 3/2016 | Cuillier De Maindreville | E21B 10/602 175/393 |
| 2016/0177630 | A1 | 6/2016 | Trunk | |
| 2017/0204673 | A1 | 7/2017 | Shi | |
| 2018/0044993 | A1 * | 2/2018 | Beavers | E21B 10/18 |
| 2018/0347283 | A1 | 12/2018 | Wendt | |
| 2019/0128072 | A1 | 5/2019 | Griffo | |
| 2020/0048968 | A1 | 2/2020 | Casad | |
| 2022/0143720 | A1 * | 5/2022 | Wagner | E21B 10/602 |
| 2022/0389766 | A1 | 12/2022 | Zahradnik | |
| 2024/0026740 | A1 | 1/2024 | Zhang | |
| 2025/0129673 | A1 | 4/2025 | Zhang | |
| 2025/0223887 | A1 | 7/2025 | Trunk | |

FOREIGN PATENT DOCUMENTS

| | | | |
|---|---|---|---|
| CN | 104612594 | B | 3/2017 |
| EP | 0107475 | B1 | 12/1988 |
| EP | 0959224 | A2 | 11/1999 |
| WO | 9624744 | A1 | 8/1996 |

OTHER PUBLICATIONS

Hariharan et al., Bit Balling Reduction by Electro-Osmosis While Drilling Shale Using a Model BHA (Bottom Hole Assembly), SPE-39311-MS, Paper presented at the IADC/SPE Drilling Conference, Dallas, Texas, Mar. 1998.

* cited by examiner

CENTRALLY LOCATED DRILL BIT CLEANING ELEMENT

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores. An earth-boring tool may include one or more cutting elements secured to a blade of the tool. Typically, the tool includes one or more jets or nozzles for circulating a drilling fluid past features of the tool such as the blades and the cutting elements. In some cases, typical downhole tools may not circulate the drilling fluid sufficiently to a central region of the bit. Additionally, typical downhole tools may not circulate the drilling fluid such that it originates from a central region of the bit.

SUMMARY

In some embodiments a downhole tool includes a body having a longitudinal axis and a fluid passage extending through the body. The downhole tool includes at least one blade having one or more engagement faces thereon. At least one junk slot extends adjacent to the at least one blade. The downhole tool includes a cleaning element at the longitudinal axis of the body. The cleaning element has a substrate bore in fluid communication with the fluid passage. The cleaning element includes at least one opening for passing a fluid from the substrate bore and out of the downhole tool through the at least one junk slot. A flow direction of the at least one opening is offset from the longitudinal axis.

In some embodiments, a downhole tool cleaning element includes a body configured to be connected to a downhole tool at a central axis of the downhole tool. The cleaning element includes a substrate bore within the body and configured for fluid communication with a fluid passage of the downhole tool when the body is connected to the downhole tool. The cleaning element includes at least one opening in the body for passing a fluid from the substrate bore, out of the at least one opening, and toward at least one feature of the downhole tool, wherein a flow direction of the at least one opening is offset from the central axis.

In some embodiments, a downhole tool includes a body having a longitudinal axis and a fluid passage extending through the body. The downhole tool includes at least one blade having one or more engagement faces thereon. At least one junk slot extends adjacent to the at least one blade. The downhole tool includes a cleaning element at the longitudinal axis of the body. The cleaning element has a substrate bore in fluid communication with the fluid passage. The cleaning element includes at least one opening or passage for passing a fluid from the substrate bore and out of the downhole tool through the at least one junk slot. A flow direction of the at least one opening is offset from the longitudinal axis. The cleaning element includes an ultra-hard layer joined to an upper surface of the cleaning element.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a perspective view of a bit including a cleaning cutting element, according to at least one embodiment of the present disclosure;

FIG. 2-2 is a top-down view of the bit of FIG. 2-1;

FIG. 2-3 is a lateral cross-sectional view of the bit of FIG. 2-1;

FIG. 2-4 is a longitudinal cross-sectional view of the bit of FIG. 2-1;

FIG. 3-1 is a side view of a cleaning cutting element, according to at least one embodiment of the present disclosure;

FIG. 3-2 is a lateral cross-section view of the cleaning cutting element of FIG. 3-1;

FIG. 4 is cross-sectional view of a representation of a cleaning cutting element, according to at least one embodiment of the present disclosure;

FIG. 8-1 is an exploded view of a cleaning cutting system, according to at least one embodiment of the present disclosure;

FIG. 8-2 is a cross-sectional view of the assembled cleaning cutting system of FIG. 8-1;

FIG. 10-1 is a side view of a representation of a cleaning element, according to at least one embodiment of the present disclosure;

FIG. 10-2 is a side cross-section view of a representation of a cleaning element implemented in a downhole tool, according to at least one embodiment of the present disclosure;

FIG. 11-1 is a side cross-section view of a representation of a cleaning element implemented in a downhole tool, according to at least one embodiment of the present disclosure;

FIG. 11-2 is a top view of a cleaning element implemented in a downhole tool, according to at least one embodiment of the present disclosure;

FIG. 13-1 illustrates a representation of a cleaning element implemented in a downhole tool, according to at least one embodiment of the present disclosure;

FIG. 13-2 illustrates a representation of a cleaning cutting element implemented in a downhole tool, according to at least one embodiment of the present disclosure;

FIGS. 15-1 and 15-2 illustrate a representation of a cleaning cutting element implemented in a downhole tool, according to at least one embodiment of the present disclosure;

FIG. 16-1 illustrates a representation of a cleaning element, according to at least one embodiment of the present disclosure; and FIG. 16-2 illustrates a representation of a cleaning element, according to at least one embodiment of the present disclosure.

DETAILED DESCRIPTION

This disclosure generally relates to devices, systems, and methods for cutting elements and/or cleaning elements having a fluid path to direct drilling fluid from a substrate bore in the substrate to conduits having exit openings in a sidewall of the substrate. Conventionally, a bit may have limited fluid flow in the center region of the bit. The bit may include cutting elements and/or cleaning elements that extend into the center region of the bit to remove the material. To remove cuttings and/or cool the bit, the bit may typically include one or more nozzles located in the junk slots between two blades. The nozzles may effectively direct fluid between the blades, but drilling fluid may not circulate around the center region of the bit. Or, due to the angles of the traditional nozzle orientation, regions of the bit such as the nose and shoulder regions, portions of the blades, engagement faces, etc., may not have efficient hydraulic energies for cooling and for carrying cuttings away quickly. This may reduce the efficiency of cutting removal and/or cooling of the cutting elements in the center, nose, and/or shoulder region, and at other features of the bit.

In accordance with at least one embodiment of the present disclosure, a cutting element may be secured to the center region of a bit. Drilling fluid may pass through the body of the bit and into a substrate bore of the cutting element. The drilling fluid may be directed through one or more conduits out of the cutting element. The conduits may direct the drilling fluid toward one or more structures on the bit. For example, the drilling fluid may be directed toward one or more junk slots between two blades of the bit, and/or along one or more blades and/or engagement faces of the bit. This may help improve fluid flow in the center and nose regions of the bit and/or along an engagement profile of the bit. Improving fluid flow in this manner may help improve the cutting efficiency of the bit and/or reduce a buildup of cuttings and other material in the center and nose regions of the bit. In some embodiments, directing of the drilling fluid in this way may be advantageously implemented to direct the drilling fluid away from one or more locations of the bit. For example, in some cases it may be desirable to reduce the hydraulic energy in unwanted regions of the bit. This may help to reduce and/or minimize wear, erosion, material loss, or other unwanted damage to the bit.

Figure 1:
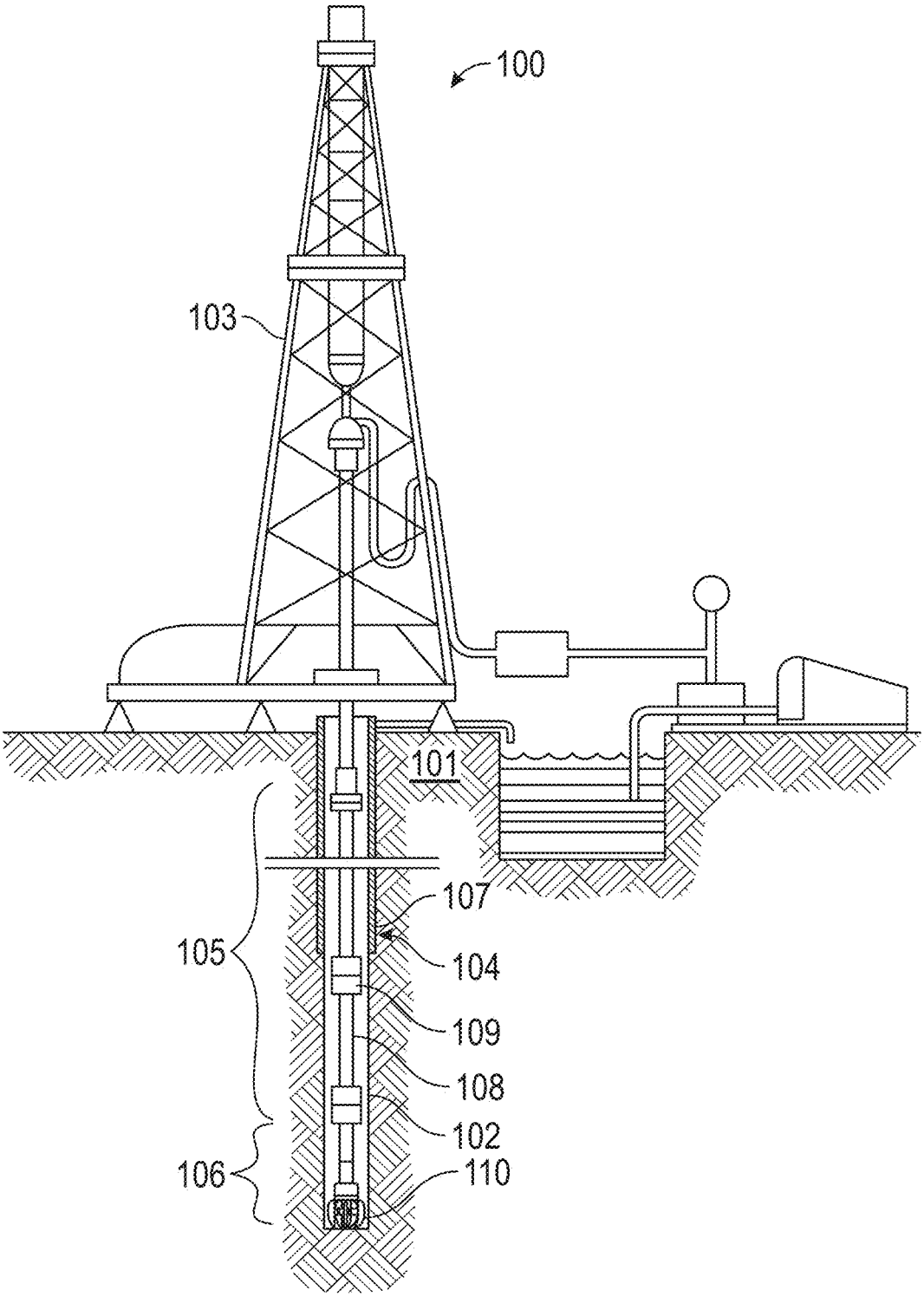
FIG. 1 shows one example of a drilling system 100 for drilling an earth formation to form a wellbore; according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of the drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

The bit 110 may include a cleaning element or a cleaning cutting element secured to a center region of the bit for circulating drilling fluid from the center region of the bit. As discussed herein, this may help to improve circulation of the drilling fluid in the center region, thereby improving drilling efficiency and/or reducing or preventing buildup of cuttings and/or other material in the center region.

Figures 1, 2:
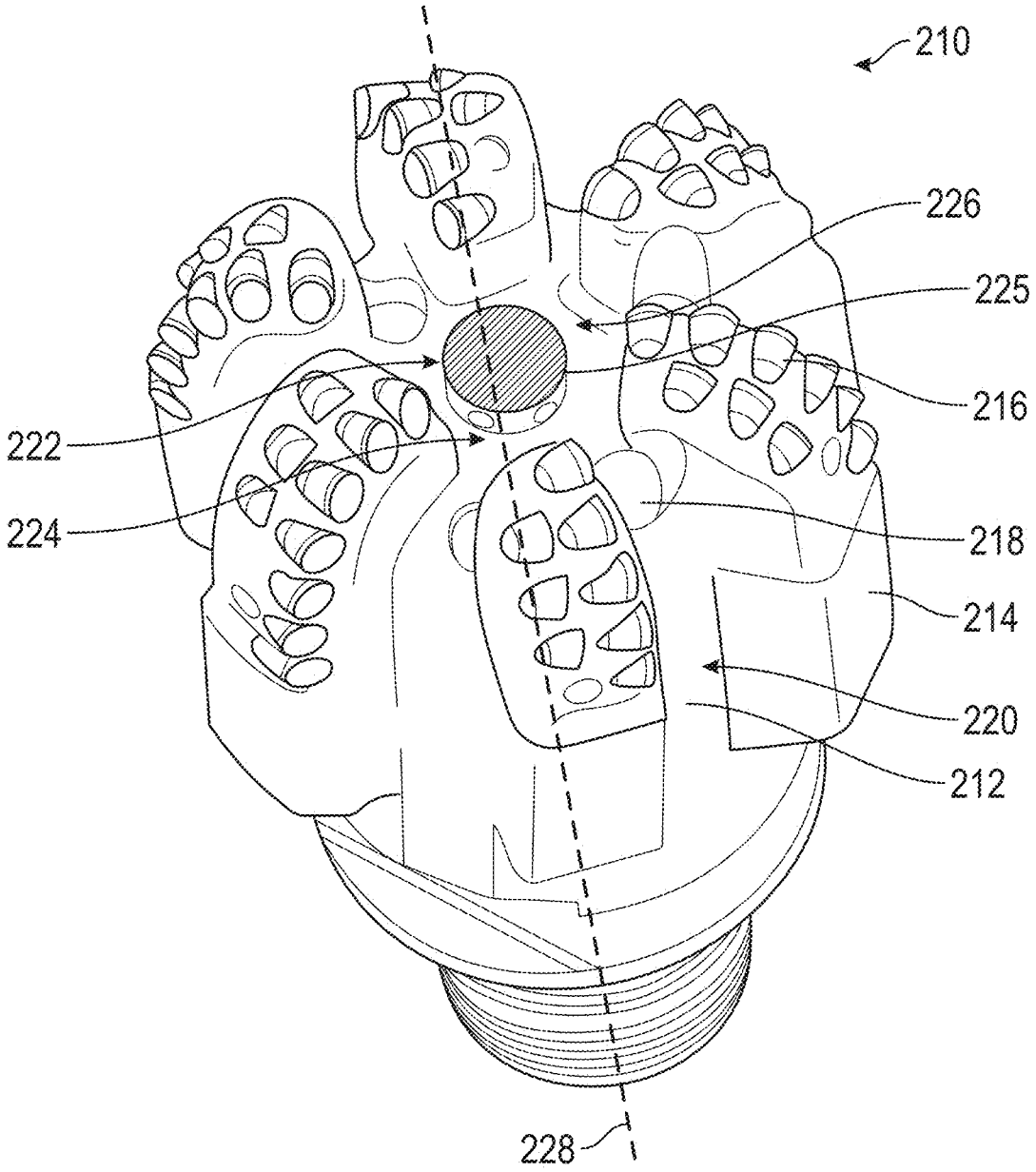
Figure 2:
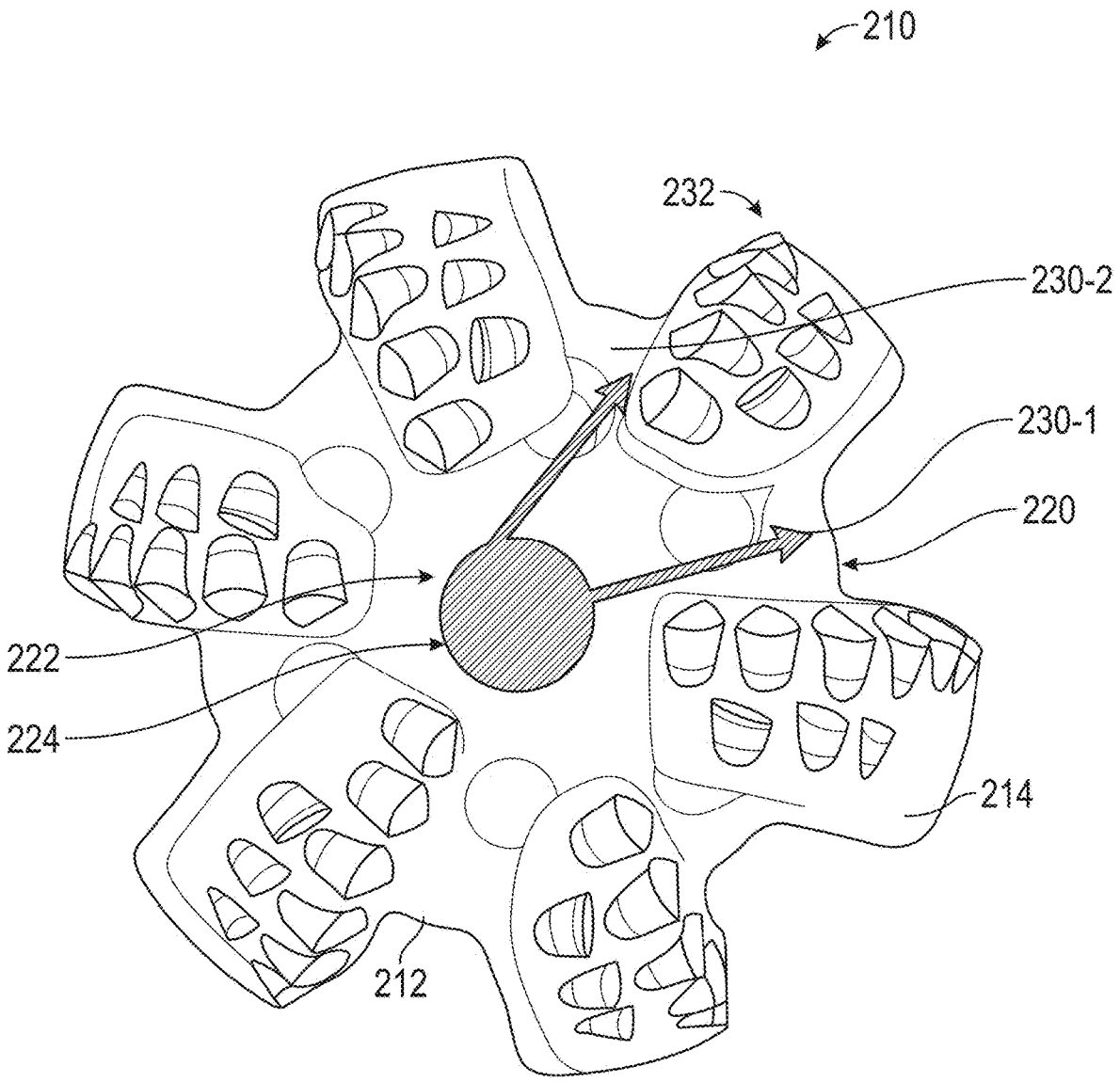

FIG. 2-1 is a representation of perspective view of a bit 210, according to at least one embodiment of the present disclosure. The bit 210 includes a body 212 and a plurality of blades 214 extending from the body 212. The bit 210 may further include a plurality of cutting elements 216 secured to one or more of the blades 214. As the bit 210 rotates, the cutting elements 216 may engage the formation and degrade at least a portion of the formation.

The bit 210 may further include one or more nozzles 218. Drilling fluid may pass through a fluid passage in the body 212 of the bit 210 and may be directed out of the bit 210 through the nozzles 218. This may help to cool the bit 210, including the cutting elements 216, the blades 214, the body 212, and other portions of the bit 210. In some situations, the drilling fluid directed from the one or more nozzles 218 may pass through junk slots 220 located between two adjacent blades 214. Cuttings, or material removed by the cutting elements 216 during drilling, may be flushed away from the cutting elements 216 through the junk slot 220 in front of the cutting elements 216.

In accordance with at least one embodiment of the present disclosure, the bit 210 may include a cleaning cutting element 222. The cleaning cutting element 222 may include an ultrahard layer 223 joined to a substrate 225. The ultrahard layer 223 may be formed from a superhard material, such as polycrystalline diamond (PCD) and/or a polycrystalline diamond compact (PDC).

In some embodiments, the cleaning cutting element may include both substrate and PCD on a top portion 251 of the cleaning cutting element 222. For example, the top portion 251 may include the conical shape of the ultrahard layer 223. The substrate 225 material may extend into the conical top portion 251 of the cleaning cutting element 222.

The ultrahard layer 223 may be shaped and located to engage the formation. For example, the ultrahard layer 223 may have a conical shape. The conical ultrahard layer 223 may engage the formation to degrade the formation. In some embodiments, the ultrahard layer 223 may be configured to engage the formation vertically along the longitudinal axis 228. As the bit 210 is lowered to the formation along the longitudinal axis 228, the ultrahard layer 223 may contact the formation and crush the formation at the point of the cone. This may help improve degradation of the formation in a center region 226 of the bit 210 where rotation of the bit 210 may limit and/or reduce the shearing motion of cutting elements 216 at the center region 226.

In some embodiments, the ultrahard layer 223 may have any other shape. For example, the ultrahard layer 223 may have a frustoconical shape, a conical shape with an offset tip of the cone, a ridge shape (e.g., an "axe" shape), a conical shape with two or more tips, any other shape, and combinations thereof.

The cleaning cutting element 222 may include a bore through the substrate 225. Drilling fluid that is directed through the body 212 may be directed into the substrate 225 of the cleaning cutting element 222 and out of the substrate 225 through one or more exit openings 224.

The exit openings 224 on the cleaning cutting element 222 may direct the drilling fluid to any structure on the bit 210. For example, the exit openings 224 may direct the drilling fluid to one or more of the blades 214. In some examples, the exit openings 224 may direct the drilling fluid to one or more of the cutting elements 216 on the blades 214. In some examples, the exit openings 224 may direct the drilling fluid to the junk slots 220 between adjacent blades 214.

In some embodiments, the drilling fluid exiting the exit openings 224 may cool the cleaning cutting element 222, the blades 214, the body 212, and/or the cutting elements 216 on the bit 210. In some embodiments, the drilling fluid exiting the exit openings 224 may flush cuttings away from the bit 210. For example, the drilling fluid exiting the exit openings 224 may flush cuttings away from the cutting elements 216 on the blades 214, through and away from the junk slots 220 between adjacent blades 214, and/or away from the body 212 of the bit 210. The drilling fluid exiting the exit openings 224 may help improve cooling and/or cutting removal of the bit 210.

In accordance with at least one embodiment of the present disclosure, the cleaning cutting element 222 may be located in a center region 226 of the bit 210. The center region 226 may be the bottom region of the bit 210. For example, the cleaning cutting element 222 may be located at the bottom of the bit 210. In some examples, the cleaning cutting element 222 may be located between the blades 214 of the bit 210. In some examples, the cleaning cutting element 222 may be located at a longitudinal axis 228 of the bit 210. In some examples, the cleaning cutting element 222 may be co-axial with the longitudinal axis 228. In some examples, the cleaning cutting element 222 may have a conical shape, and a point of the conical shape of the cleaning cutting element 222 may intersect the longitudinal axis 228.

In some embodiments, the bit 210 may include a cleaning cutting element 222 in any portion of the bit 210. For example, the bit 210 may include a cleaning cutting element 222 on a blade 214 of the bit 210, on a body 212 of the bit 210 offset from the longitudinal axis 228 of the bit 210. Placing the cleaning cutting element 222 in any portion of the bit 210 may help to improve the fluid flow throughout the bit 210.

In some embodiments, the cleaning cutting element 222 may include an exit opening 224 for each junk slot 220 in the bit 210. For example, a conduit quantity of the fluid conduits 236 and/or the exit openings 224 may be the same as a blade quantity of the blades 214. In some embodiments, the cleaning cutting element 222 may include fewer exit openings 224 than junk slots 220. For example, the conduit quantity of the fluid conduits 236 and/or the exit openings 224 may be less than the blade quantity of the blades 214. In some examples, the cleaning cutting element 222 may include an exit opening 224 for each primary blade 214. In some examples, the cleaning cutting element 222 may include more exit openings 224 than blades 214 and/or junk slots 220. For example, the conduit quantity of the fluid conduits 236 and/or the exit openings 224 may be greater than the blade quantity of the blades 214.

In some embodiments, the exit openings 224 may be directed at specific features of the bit 210. For example, the exit openings 224 may be directed at a center of the junk slots 220. In some examples, the exit openings 224 may be directed at the blades 214. In some examples, the exit openings 224 may be directed at particular cutting elements 216 and/or groups of cutting elements 216. In some examples, the exit openings 224 may be directed at a leading edge of the blades 214. In some examples, the exit openings 224 may be directed at one or more of the nozzles 218 to facilitate and/or improve flow of the drilling fluid from the nozzle 218. In some examples, different exit openings 224 may be directed at different features of the bit 210. For example, a first exit opening 224 may be directed at a junk slot 220 and a second exit opening 224 may be directed at a cutting element 216.

FIG. 2-2 is a representation of a top-down view of the bit 210 illustrated in FIG. 2-1. The exit openings 224 may direct a flow (collectively 230) of drilling fluid to one or more features of the bit 210. For example, an exit opening 224 may direct a first flow 230-1 of the drilling fluid to a junk slot 220 between two blades 214. The first flow 230-1 may be directed to the center of the junk slot 220. This may help to increase fluid flow through the bit 210, which may help to flush cuttings away from the center region 226 of the bit 210, help to flush cuttings away from the blades 214, help to flush cuttings out of the junk slots 220, increase cooling on one or more structures of the bit 210, perform any other action, and combinations thereof.

In some embodiments, the flow 230 of the drilling fluid may be oriented perpendicular from the cleaning cutting element 222. The conduits opening at the exit openings 224 may be oriented toward and may open perpendicular to the outer cylindrical surface of the substrate. This may cause the flow 230 of the drilling fluid to exit the exit openings 224 perpendicularly or approximately perpendicularly to the cleaning cutting element 222. In the embodiment shown in FIG. 2-2, the cleaning cutting element 222 is rotationally oriented in the body 212 to direct the first flow 230-1 of the drilling fluid perpendicularly away from the cleaning cutting element 222 toward the junk slot 220. In some embodiments, the cleaning cutting element 222 may be rotationally oriented to be oriented at any feature of the bit 210, such as the blade 214 and/or one of the cutting elements 216.

In some embodiments, the flow 230 of the drilling fluid may be oriented transverse, offset, or non-perpendicular to the cleaning cutting element 222. For example, the flow 230 of the drilling fluid may be oriented transverse or non-perpendicular to the outer surface of the substrate and/or the ultrahard layer of the cleaning cutting element 222. For instance, the flow direction of the flow 230 may be offset from and/or may not pass through or align with a central axis (e.g., the longitudinal axis 228) of the cleaning cutting element 222. This may allow the flow 230 to be oriented at a specific feature of the bit 210. For example, in the embodiment shown in FIG. 2-2, a second flow 230-2 of the drilling fluid is oriented transverse to (e.g., offset from the central axis of) the cleaning cutting element 222 to direct the second flow 230-2 to the cutting element 216 shown and/or to direct the second flow 230-2 to more closely follow the leading face 232 of the blade 214. In some embodiments, the flow direction of the second flow 230-2 is directed parallel to some or all of the blade 214. In some embodiments, the flow direction of the second flow 230-2 is directed toward the blade 214 such that an angle between the flow 230-2 and at least a portion of the blade is not divergent (e.g., is parallel or convergent). For example, as shown, the flow direction of the first flow 230-1 is directed down a junk slot 220 such that the flow 230-1 diverges (e.g., travels away from) from each of the adjacent blades 214 as the flow proceeds further down the bit 210. This may lead to the cleaning and/or cooling effects, etc., of the flow 230-1 having a lesser effect on portions of the blades 214 and/or cutting elements 216 that are positioned further from the cleaning cutting element 222. The flow direction of the second flow 230-2 may be offset from the central axis and/or transverse as described such that it may pass more closely to some or all of the blade 214 and/or cutting elements 216 that are positioned further from the cleaning cutting element 222. In this way, the flow 230-2 being parallel or convergent to some or all of one of the blades 214 may improve the functionality of the cleaning cutting element 222 over conventional nozzles 218. For example, directing the second flow 230-2 parallelly or convergently to the cutting element 216 and/or the leading face 232 of the blade 214 (and/or to one or more portions of the blade and/or cutting elements 16 positioned further down the bit 210) may help to improve operation of the bit by flushing cuttings away from these locations, provide cooling to these location, otherwise improving performance of the bit 210, and combinations thereof.

Figures 2, 3:
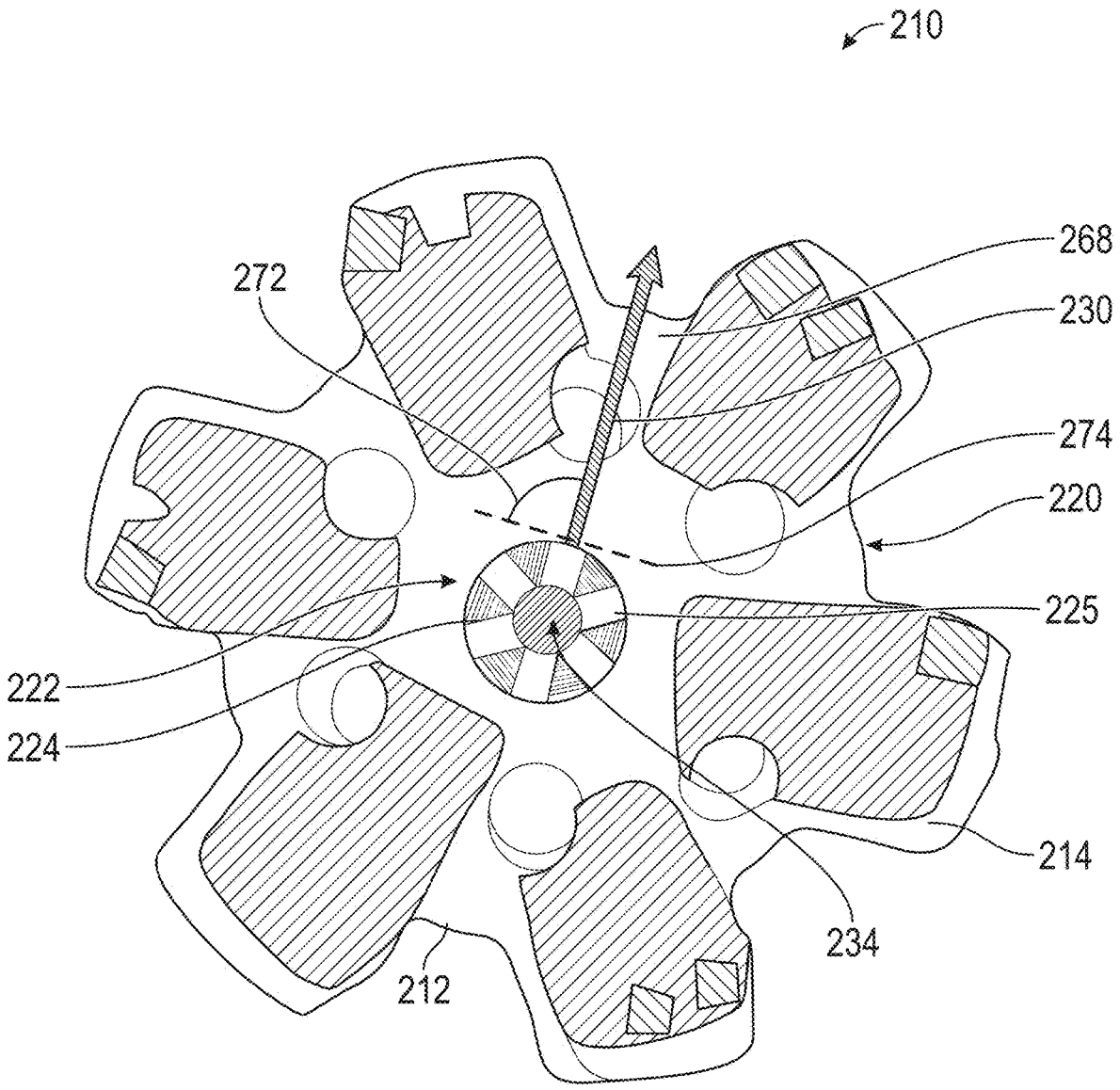

FIG. 2-3 is a lateral cross-sectional view of the bit 210 illustrated in FIG. 2-1. In the cross-sectional view shown, the cleaning cutting element 222 includes six fluid conduits 236 extending from a substrate bore 234 in the substrate 225 of the cleaning cutting element 222. The substrate bore 234 may extend at least partially through the substrate 225. The fluid conduits 236 extend through the substrate 225 to six exit openings 224 in the outer surface of the cleaning cutting element 222. The six fluid conduits 236 and exit openings 224 shown are oriented to direct flows 230 of drilling fluid from the substrate bore 234 to each of the junk slots 220 between the blades 214. As discussed herein, this may help to flush cuttings out of the center region 226 of the bit 210 and/or cool the bit 210.

While the embodiment shown in FIG. 2-3 illustrates six fluid conduits 236 directing six flows 230 from the cleaning cutting element 222, it should be understood that the cleaning cutting element 222 may include any number of fluid conduits 236 directing any number of flows 230 from the cleaning cutting element 222. Further, while the embodiment shown illustrates the flows 230 as extending perpendicular to the cleaning cutting element 222, it should be understood that the flow 230 may extend in any direction from the cleaning cutting element 222 and/or toward any feature of the bit 210, such as the transverse or offset flows discusses above.

In some embodiments, the fluid conduit 236 may extend at a radial conduit angle 272 that extends between a conduit axis 268 through the fluid conduit 236 and a tangent line 274 that is tangent to the substrate bore 234 and/or the circumferential wall of the substrate 225. In some embodiments, the radial conduit angle 272 may be in a range having an upper value, a lower value, or upper and lower values including any of 90°, 85°, 80°, 75°, 70°, 65°, 60°, 55°, 50°, 45°, or any value therebetween. For example, the radial conduit angle 272 may be greater than 45°. In another example, the radial conduit angle 272 may be less than 90°. In yet other examples, the radial conduit angle 272 may be any value in a range between 45° and 90°. In some embodiments, it may be critical that the radial conduit angle 272 is between 60° and 90° to direct the drilling fluid to a particular feature of the bit. In some embodiments, each of the fluid conduits 236 may have the same radial conduit angle 272. In some embodiments, different fluid conduits 236 may have different radial conduit angles 272. In some embodiments, adjacent fluid conduits 236 may have the same or different radial conduit angles 272.

Figures 2, 3, 4:
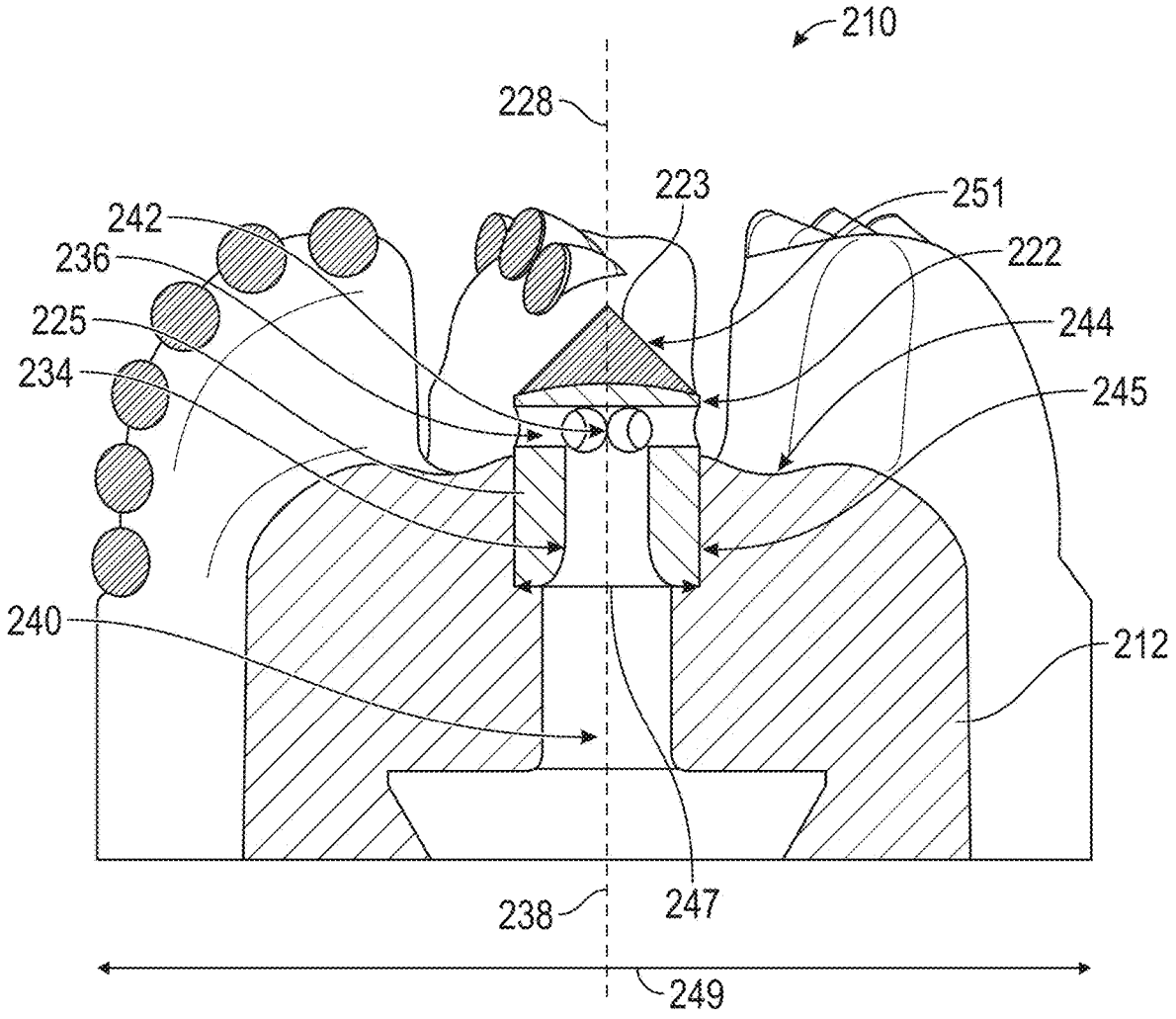
Figures 1, 3:
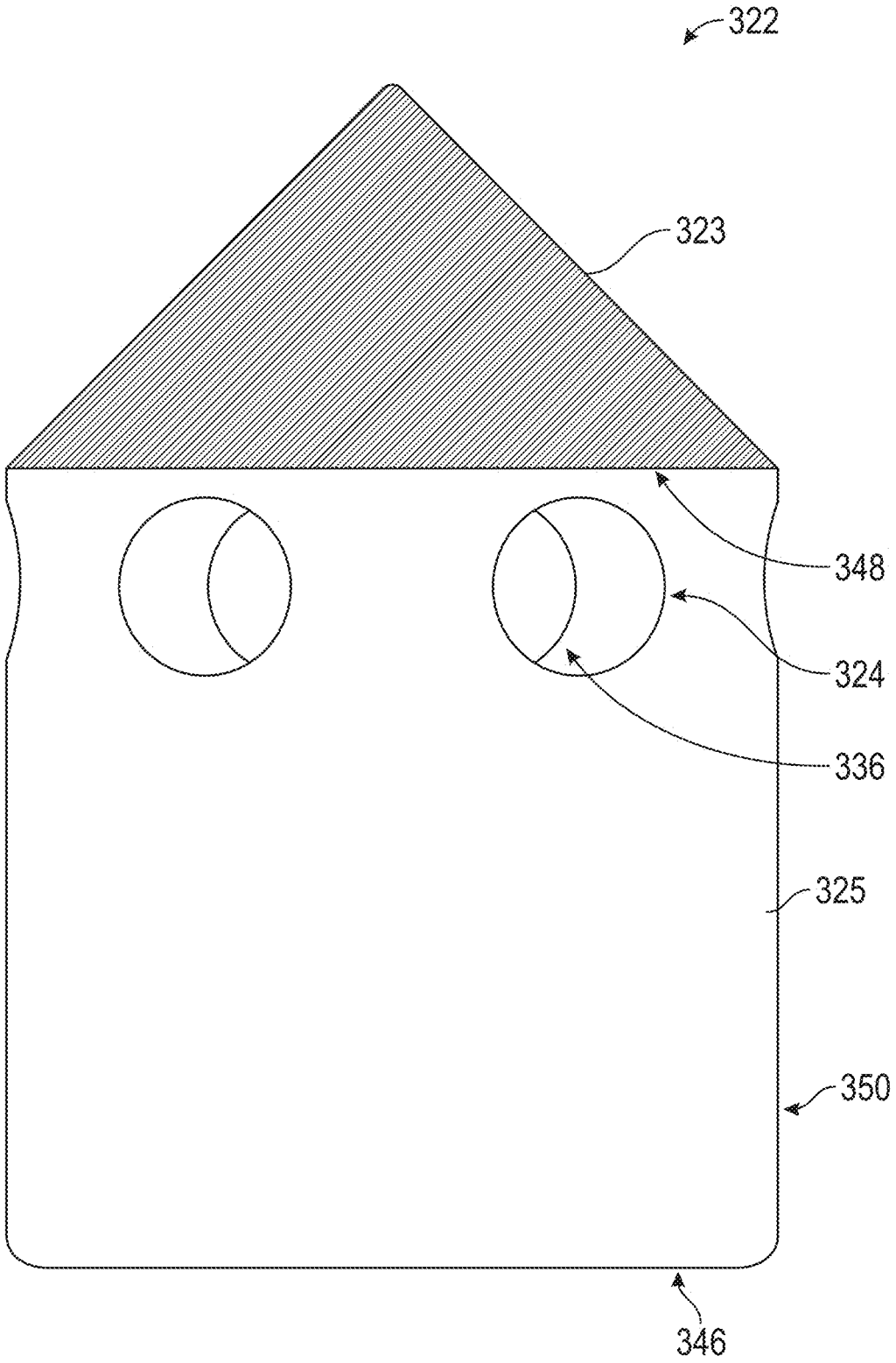
Figures 2, 3:
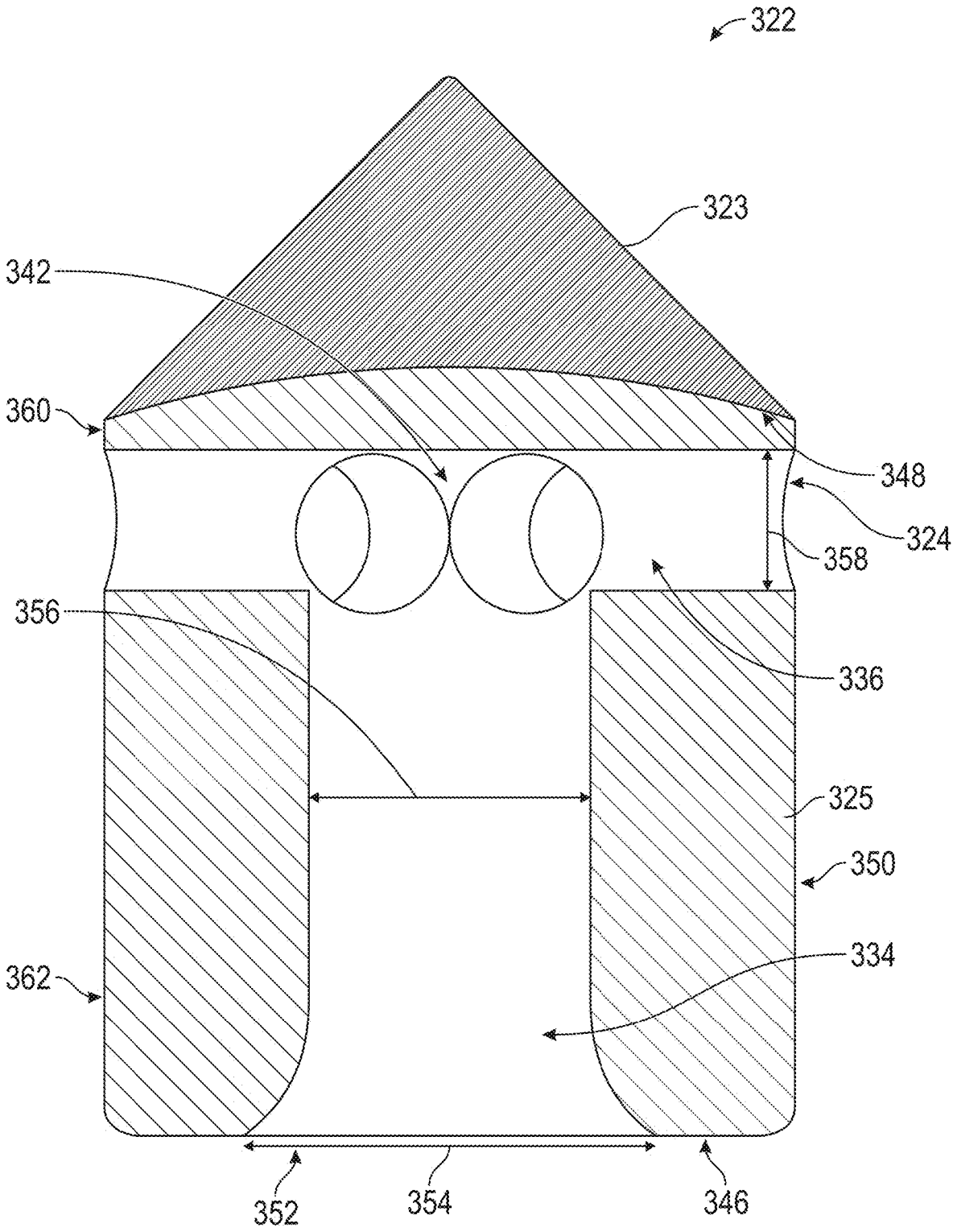
Figure 4:
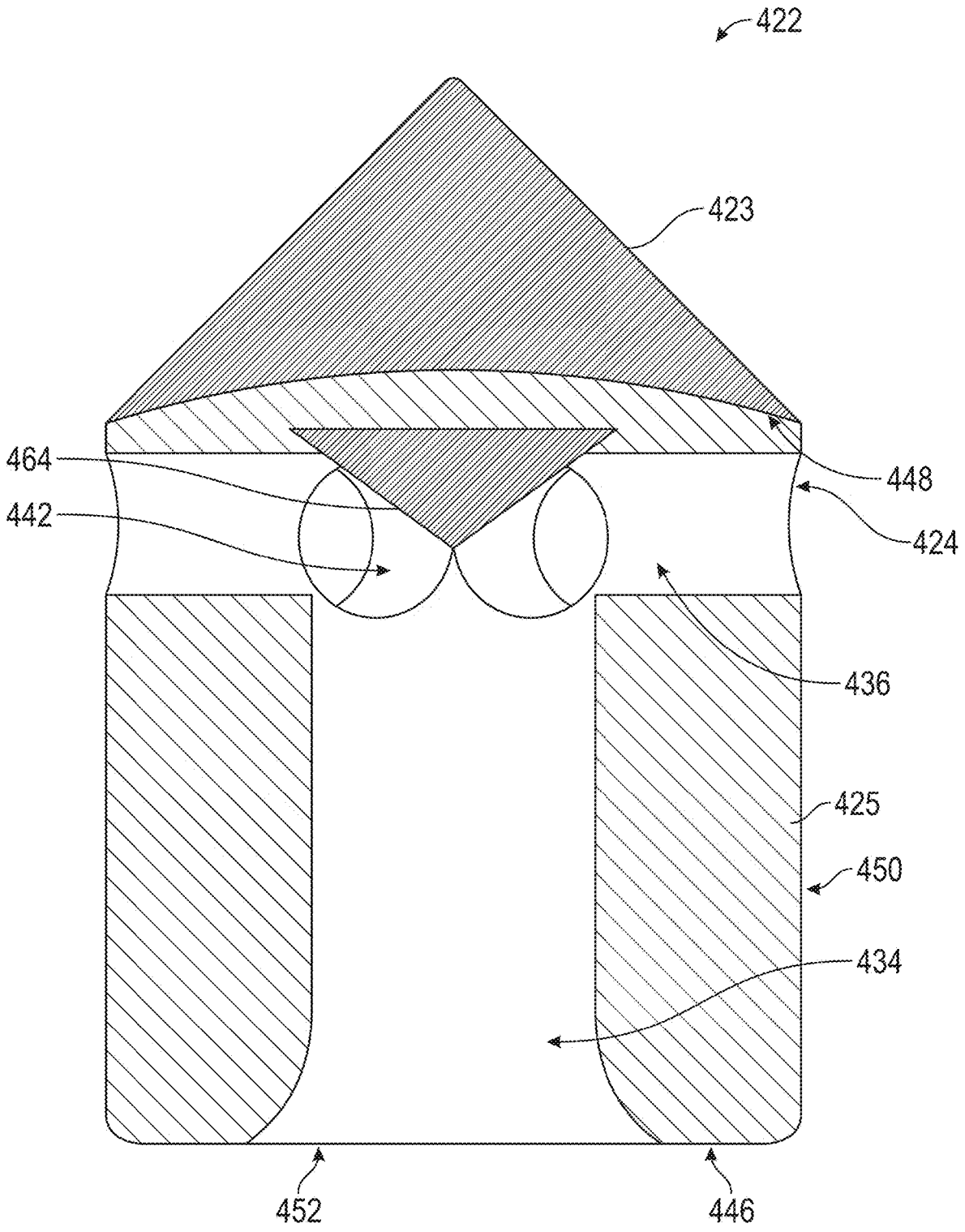

FIG. 2-4 is a longitudinal cross-sectional view of the bit 210 illustrated in FIG. 2-1. As may be seen, a primary flow 238 of the drilling fluid may flow through a fluid passage 240 in the body 212 of the bit 210. The fluid passage 240 may be in fluid communication with the substrate bore 234. For example, the primary flow 238 of the drilling fluid may pass from the fluid passage 240 in the body 212 and into the substrate bore 234 formed in the substrate 225 of the cleaning cutting element 222. The primary flow 238 may be diverted at a junction 242 in the cleaning cutting element 222 to the fluid conduits 236. This may cause the primary flow 238 to be separated into the flows 230 of drilling fluid that are directed out of the fluid conduits 236 and to the various features of the bit 210.

In the embodiment shown, the junction 242 is located at an upper portion of the cleaning cutting element 222. For example, the junction 242 may be located proximate the ultrahard layer 223. In some examples, the junction 242 may be located in the substrate 225 of the cleaning cutting element 222 proximate the ultrahard layer 223. In some embodiments, the junction 242 may be located at any portion along the length of the cleaning cutting element 222. The junction 242 may be located to help direct and/or split the primary flow 238 of drilling fluid into the fluid conduits 236 and the flows 230 that are directed to the various features of the bit 210.

As discussed in further detail herein, the substrate 225 may include a deflector plate at the junction 242 between the substrate bore 234 and the fluid conduits 236. The deflector plate may be located at an upper surface of the junction 242 to contact the drilling fluid when the drilling fluid passes into the junction 242. The deflector plate may help to redirect the drilling fluid and reduce wear and/or erosion of the substrate 225 at the junction 242.

As may be seen, the substrate 225 of the cleaning cutting element 222 may extend above a bit junk slot surface 244 of the body 212. The substrate 225 may extend above the bit junk slot surface 244 of the body 212 to allow the exit openings 224 to direct the flow 230 of the drilling fluid out of the fluid conduits 236 and toward the features of the bit 210. In some embodiments, extending the substrate 225 above the bit junk slot surface 244 may cause the ultrahard layer 223 to extend further above the bit junk slot surface 244, thereby engaging the formation above the bit junk slot surface 244.

The cleaning cutting element 222 may be secured to the body 212 of the bit 210 at the bit junk slot surface 244. For example, the body 212 may include a cutting element pocket 245. The cutting element pocket 245 may extend into the body 212 from the bit junk slot surface 244 of the body 212. The cleaning cutting element 222 may be brazed to the bit 210 in the cutting element pocket 245 to secure the cleaning cutting element 222 to the body 212. In some embodiments, the cleaning cutting element 222 may be secured to the bit 210 at the cutting element pocket 245 in any manner, such as through weld, braze, mechanical fastener, shrink fit, press-fit, interference fit, any other manner, and combinations thereof.

The cleaning cutting element 222 includes a cutting element diameter 247. In some embodiments, the cutting element diameter 247 may be in a range having an upper value, a lower value, or upper and lower values including any of 0.5 in. (1.3 cm), 0.6 in. (1.5 cm), 0.7 in. (1.8 cm), 0.8 in. (2.0 cm), 0.9 in. (2.3 cm), 1.0 in. (2.5 cm), 1.1 in. (2.8 cm), 1.2 in. (3.0 cm), 1.3 in. (3.3 cm), 1.4 in. (3.6 cm), 1.5 in. (3.8 cm), 2.0 in. (5.1 cm), or any value therebetween. For example, the cutting element diameter 247 may be greater than 0.5 in. (1.3 cm). In another example, the cutting element diameter 247 may be less than 2.0 in. (5.1 cm). In yet other examples, the cutting element diameter 247 may be any value in a range between 0.5 in. (1.3 cm) and 2.0 in. (5.1 cm). In some embodiments, it may be critical that the cutting element diameter 247 is between 0.5 in. (1.3 cm) and 2.0 in. (5.1 cm) to allow the drilling fluid to flow through the substrate 325.

The bit 210 includes a bit diameter 249. In some embodiments, the bit diameter 249 may be in a range having an upper value, a lower value, or upper and lower values including any of 3 in. (7.6 cm), 4 in. (10.2 cm), 5 in. (12.7 cm), 6 in. (15.2 cm), 7 in. (17.8 cm), 8 in. (20.3 cm), 9 in. (22.9 cm), 10 in. (25.4 cm), 11 in. (27.9 cm), 12 in. (30.5 cm), 13 in. (33.0 cm), 14 in. (35.6 cm), 15 in. (38.1 cm), 16 in. (40.6 cm), 17 in. (43.2 cm), 18 in. (45.7 cm), 26 in. (66.0 cm), or any value therebetween. For example, the bit diameter 249 may be greater than 3 in. (7.6 cm). In another example, the bit diameter 249 may be less than 26 in. (66 cm). In yet other examples, the bit diameter 249 may be any value in a range between 3 in. (7.6 cm) and 26 in. (66 cm).

In some embodiments, the cleaning cutting element 222 and the bit 210 may have a cutting element to bit diameter ratio. In some embodiments, the cutting element to bit diameter ratio may be in a range having an upper value, a lower value, or upper and lower values including any of 1:3, 1:4, 1:5, 1:6, 1:8, 1:9, 1:10, 1:11, 1:12, 1:15, 1:20, or any value therebetween. For example, the cutting element to bit diameter ratio may be greater than 1:3. In another example, the cutting element to bit diameter ratio may be less than 1:20. In yet other examples, the cutting element to bit diameter ratio may be any value in a range between 1:3 and 1:20. In some embodiments, it may be critical that the cutting element to bit diameter ratio is between 1:5 and 1:12 to provide fluid flow to the center region of the bit.

In accordance with at least one embodiment of the present disclosure, the cleaning cutting element 522 may be located at the longitudinal axis 228 of the bit 210. For example, a longitudinal axis (e.g., the longitudinal axis 570 illustrated in FIG. 5) of the cleaning cutting element 222 may be coaxial with the longitudinal axis 228 of the bit. In some embodiments, the longitudinal axis of the cleaning cutting element 222 may be offset from the longitudinal axis 228 of the bit 210. In some embodiments, the longitudinal axis of the cutting element 222 may be parallel with the longitudinal axis 228 of the bit. In some embodiments, the cleaning cutting element 222 may not be parallel, or may be transverse to the longitudinal axis 228 of the bit.

FIG. 3-1 is side view of a representation of a cleaning cutting element 322, according to at least one embodiment of the present disclosure. The cleaning cutting element 322 may include a substrate 325 and an ultrahard layer 323 joined to the substrate 325. The substrate 325 includes a plurality of fluid conduits 336 that exit the body of the substrate 325 at an exit opening 324.

The substrate 325 includes a bottom surface 346 and an upper surface 348 opposite the bottom surface 346. A circumferential wall 350 may extend between the upper surface 348 and the bottom surface 346. In the embodiment shown, the substrate 325 may have a cylindrical shape, with the bottom surface 346 having a circular shape, the upper surface 348 having a circular shape, and the circumferential wall 350 forming the cylindrical body between the bottom surface 346 and the upper surface 348. But it should be understood that the substrate 325 may have other shapes, such as prismatic volumes having any cross-sectional shape, including ovoid, circular, triangular, square, rectangular, pentagonal, hexagonal, heptagonal, octagonal, nonagonal, decagonal, any other polygonal shape, and combinations thereof.

As discussed herein, the substrate 325 includes a substrate bore extending at least partially therethrough. The substrate bore has a bore inlet in the bottom surface 346. The substrate bore may extend through the body of the substrate 325 to a junction between the bottom surface 346 and the upper surface 348. At the junction, multiple fluid conduits 336 may extend toward the circumferential wall 350. The fluid conduits 336 may exit the substrate 325 at an exit opening 324 in the circumferential wall 350. In this manner, the drilling fluid may be directed out of the cleaning cutting element 322.

In some embodiments, the exit openings 324 may be evenly circumferentially distributed about the circumferential wall 350 such that a spacing between adjacent exit openings 324 is the same. In some embodiments, the exit opening 324 may be unevenly circumferentially distributed about the circumferential wall 350 such that a spacing between adjacent exit openings 324 is different. The circumferential spacing of the exit openings 324 may be based on the targets for the drilling fluid directed out of the substrate 325 through the exit openings 324.

In some embodiments, the exit opening 324 may be evenly longitudinally distributed along the circumferential wall 350 such that a spacing between the exit openings 324 and the upper surface 348 (and the bottom surface 346) may be the same. In some embodiments, the exit opening 324 may be unevenly longitudinally distributed along the circumferential wall 350 such that a spacing between the exit openings 324 and the upper surface 348 (and the bottom surface 346) may be different. The longitudinal spacing of the exit openings 324 may be based on the targets for the drilling fluid directed out of the substrate 325 through the exit openings 324.

FIG. 3-2 is a longitudinal cross-sectional view of the cleaning cutting element 322 of FIG. 3-1. The substrate 325 includes a substrate bore 334 passing therethrough. As discussed herein, drilling fluid may pass into the substrate bore 334 from a fluid passage in the body of the bit. The substrate bore 334 has an inlet 352 in the bottom surface 346. Drilling fluid may enter the substrate 325 at the inlet 352 in the bottom surface 346 and pass into the substrate bore 334. The drilling fluid may be diverted to the fluid conduits 336 at a junction 342 located at or proximate the upper surface 348 of the substrate 325. The drilling fluid may pass out of the substrate 325 through the exit openings 324 of the fluid conduits 336.

In the embodiment shown, the inlet 352 in the bottom surface 346 has an inlet diameter 354 and a bore diameter 356 in the body of the substrate 325. The inlet 352 may be flared such that the inlet diameter 354 is greater than the bore diameter 356 to help improve the hydraulic flow through the substrate bore 334 and/or increase the pressure of the drilling fluid through the substrate bore 334. In some embodiments, the inlet diameter 354 of the inlet 352 may be greater than an exit diameter 358 of the exit openings 324. This may help to increase the pressure of the drilling fluid as the drilling fluid exits the substrate 325 through the exit openings 324.

In some embodiments, the inlet diameter 354 may be in a range having an upper value, a lower value, or upper and lower values including any of 0.3 in. (0.8 cm), 0.4 in. (1.0 cm), 0.5 in. (1.3 cm), 0.5 in. (1.3 cm), 0.6 in. (1.5 cm), 0.7 in. (1.8 cm), 0.8 in. (2.0 cm), 0.9 in. (2.3 cm), 1.0 in. (2.5 cm), 1.1 in. (2.8 cm), 1.2 in. (3.0 cm), 1.3 in. (3.3 cm), or any value therebetween. For example, the inlet diameter 354 may be greater than 0.3 in. (0.8 cm). In another example, the inlet diameter 354 may be less than 1.3 in. (3.3 cm). In yet other examples, the inlet diameter 354 may be any value in a range between 0.3 in. (0.8 cm) and 1.3 in. (3.3 cm). In some embodiments, it may be critical that the inlet diameter 354 is between 0.5 in. (1.3 cm) and 1.1 in. (2.8 cm) to maintain sufficient flow of the drilling fluid through the substrate bore 334.

In some embodiments, the exit diameter 358 may be in a range having an upper value, a lower value, or upper and lower values including any of 0.1 in. (0.3 cm), 0.2 in. (0.5 cm), 0.3 in. (0.8 cm), 0.4 in. (1.0 cm), 0.5 in. (1.3 cm), 0.5 in. (1.3 cm), 0.6 in. (1.5 cm), 0.7 in. (1.8 cm), 0.8 in. (2.0 cm), 0.9 in. (2.3 cm), 1.0 in. (2.5 cm), or any value therebetween. For example, the exit diameter 358 may be greater than 0.1 in. (0.3 cm). In another example, the exit diameter 358 may be less than 1.0 in. (2.5 cm). In yet other examples, the exit diameter 358 may be any value in a range between 0.1 in. (0.3 cm) and 1.0 in. (2.5 cm). In some embodiments, it may be critical that the exit diameter 358 is between 0.3 in. (0.8 cm) and 0.8 in. (2.0 cm) to maintain a flow rate and pressure of the flow out of the fluid conduits 336.

The inlet diameter 354 and the exit diameter 358 may have an inlet to exit ratio. In some embodiments, the inlet to exit ratio may be in a range having an upper value, a lower value, or upper and lower values including any of 1:1, 5:4, 4:3, 3:2, 2:1, 3:1, 4:1, 5:1, or any value therebetween. For example, the inlet to exit ratio may be greater than 1:1. In another example, the inlet to exit ratio may be less than 5:1. In yet other examples, the inlet to exit ratio may be any value in a range between 1:1 and 5:1. In some embodiments, it may be critical that the inlet to exit ratio is between 4:3 and 2:1 to maintain a desired pressure of the drilling fluid at the exit openings 324. In some embodiments, each of the exit openings 324 may have the same inlet to exit ratio. In some embodiments, different exit openings may have different inlet to exit ratios.

As discussed herein, the ultrahard layer 323 may be joined to the substrate 325 at the upper surface 348 of the substrate 325. In some embodiments, the ultrahard layer 323 may be directly formed on the substrate 325. For example, when the ultrahard layer 323 is formed using high-pressure high-temperature (HPHT) techniques, the ultrahard layer 323 may be formed on the substrate 325.

In some embodiments, the ultrahard layer 323 may be joined to an upper portion 360 of the substrate 325. A lower portion 362 of the substrate may be formed after forming the ultrahard layer 323 on the upper portion 360 of the substrate 325. For example, the lower portion 362 may be additively manufactured on the upper portion 360 base. Additively manufacturing may include forming the substrate 325 layer-by-layer on top of the upper portion 360. In accordance with at least one embodiment of the present disclosure, additively manufacturing at least a portion of the substrate may allow for the formation of the substrate bore 334 and the fluid conduits 336 in the substrate 325. This may help to reduce the manufacturing time, including time for milling, grinding, and otherwise processing the substrate 325. In some embodiments, additively manufacturing at least a portion of the substrate 325 may allow the substrate 325 to include complex geometries of the substrate bore 334 and/or the fluid conduits 336 that may not be millable and/or grindable. For example, additively manufacturing the substrate 325 may allow the substrate bore 334 and/or the fluid conduits 336 to include curved portions to direct the fluid conduits 336 and exit openings 324 to a particular feature of the bit.

In some embodiments, the substrate 325 may be formed in a single massive block, such as through casting, infiltration, sintering, and so forth. The substrate bore 334 and/or the fluid conduits 336 may be formed in the substrate 325 after the substrate 325 is formed. For example, the substrate bore 334 and/or the fluid conduits 336 may be drilled, milled, and/or ground into the body of the substrate 325. This may help to simplify the manufacturing of the cleaning cutting element 322 and/or the substrate 325.

FIG. 4 is cross-sectional view of a representation of a cleaning cutting element 422, according to at least one embodiment of the present disclosure. The cleaning cutting element 422 may include a substrate 425 and an ultrahard layer 423 joined to the substrate 425. The substrate 425 includes a substrate bore 434 passing at least partially therethrough. As discussed herein, drilling fluid may pass into the substrate bore 434 through an inlet 452 in fluid communication with a fluid passage in the body of the bit. The drilling fluid may be diverted to the fluid conduits 436 at a junction 442 located at or proximate the upper surface 448 of the substrate 425. The drilling fluid may pass out of the substrate 425 through the exit openings 424 of the fluid conduits 436 exiting out of a circumferential wall 450 that extends between the bottom surface 446 and the upper surface 448.

In accordance with at least one embodiment of the present disclosure, the cleaning cutting element 422 may include a deflector 464. The deflector 464 may be located at the junction 442 between the substrate bore 434 and the fluid conduits 436. The deflector 464 may be located to receive the impact of the drilling fluid at the junction 442. Drilling fluid may impact the deflector 464 before being diverted to the fluid conduits 436. The deflector 464 may prevent the drilling fluid from engaging or contacting the matrix material of the substrate 425 at the junction 442. This may help to reduce or prevent damage to the substrate 425 caused by the drilling fluid engaging the matrix material of the substrate 425 at the junction 442. This may help to extend the operation lifetime of the cleaning cutting element 422.

In some embodiments, the deflector 464 may be formed from an erosion—and/or wear-resistant material. For example, the deflector 464 may be formed from PCD and/or a PDC. Forming the deflector 464 from an erosion—and/or wear-resistant material may help to reduce the wear on the deflector 464 and/or other portions of the cleaning cutting element 422 caused by drilling fluid.

In the embodiment shown, the deflector 464 has a conical shape. A conical shape may help to divert the flow of the drilling fluid into the fluid conduits 436. The deflector 464 may have any shape. For example, the deflector 464 may have a domed shape, a pyramidal shape, a frustoconical shape, any other shape, and combinations thereof.

In some embodiments, the deflector 464 may be formed with the substrate 425 when the ultrahard layer 423 is formed on the substrate 425. In some embodiments, the deflector 464 may be separately formed from the substrate 425 and subsequently secured to the substrate 425 in the upper surface of the junction 442.

Figure 5:
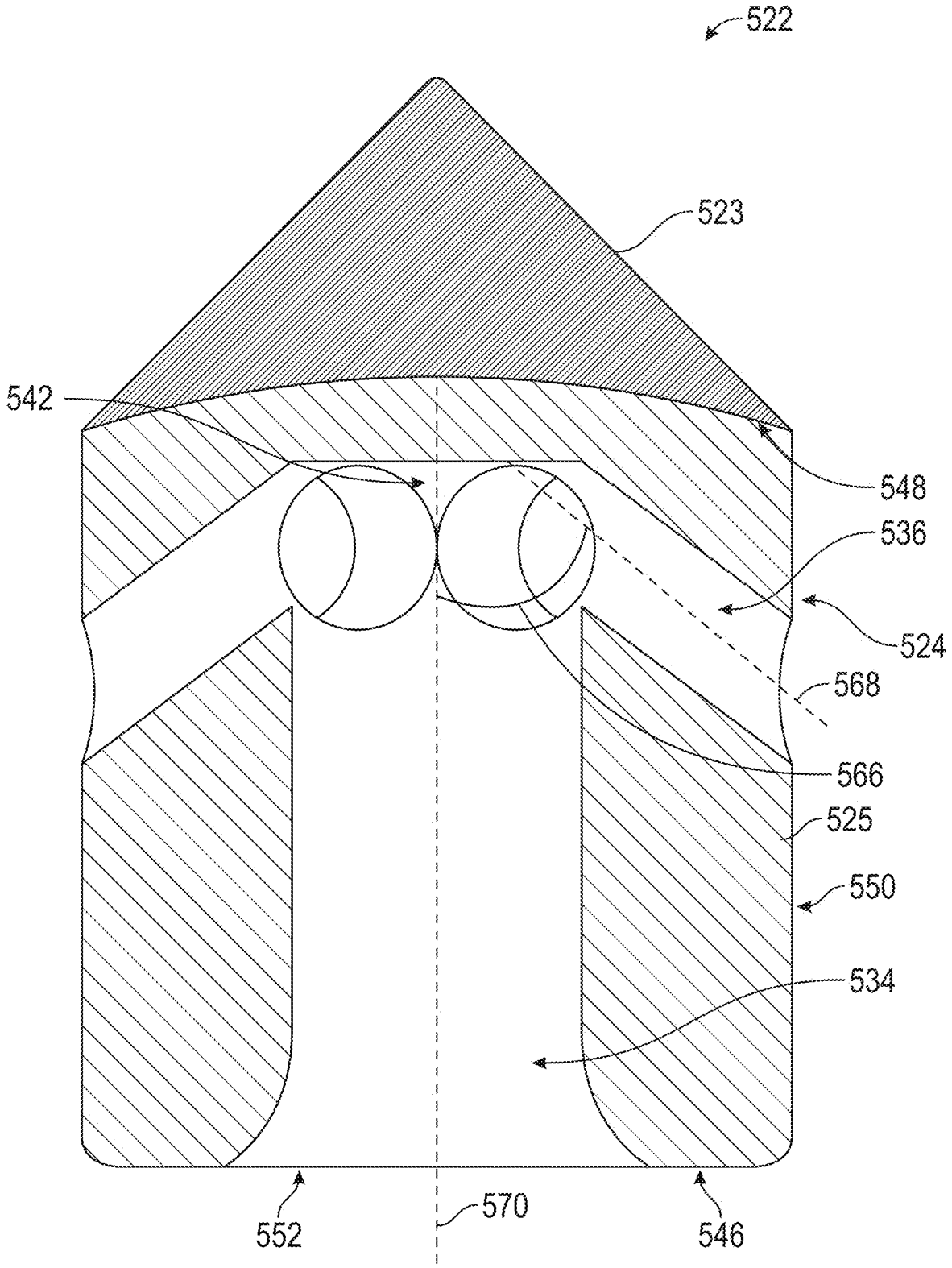
FIG. 5 is cross-sectional view of a representation of a cleaning cutting element, according to at least one embodiment of the present disclosure.

FIG. 5 is cross-sectional view of a representation of a cleaning cutting element 522, according to at least one embodiment of the present disclosure. The cleaning cutting element 522 may include a substrate 525 and an ultrahard layer 523 joined to the substrate 525. The substrate 525 includes a substrate bore 534 passing at least partially therethrough. As discussed herein, drilling fluid may pass into the substrate bore 534 through an inlet 552 in fluid communication with a fluid passage in the body of the bit. The drilling fluid may be diverted to the fluid conduits 536 at a junction 542 located at or proximate the upper surface 548 of the substrate 525. The drilling fluid may pass out of the substrate 525 through the exit openings 524 of the fluid conduits 536 exiting out of a circumferential wall 550 that extends between the bottom surface 546 and the upper surface 548.

In the embodiment shown, the fluid conduits 536 may be oriented with a longitudinal conduit angle 566 formed between a conduit axis 568 of the fluid conduit 536 and a longitudinal axis 570 of the cleaning cutting element 522. The longitudinal conduit angle 566 may be any angle. In some embodiments, the longitudinal conduit angle 566 may be in a range having an upper value, a lower value, or upper and lower values including any of 145°, 120°, 110°, 100°, 90°, 85°, 80°, 75°, 70°, 65°, 60°, 55°, 50°, 45°, or any value therebetween. For example, the longitudinal conduit angle 566 may be greater than 45°. In another example, the longitudinal conduit angle 566 may be less than 90°. In yet other examples, the longitudinal conduit angle 566 may be any value in a range between 45° and 90°. In some embodiments, it may be critical that the longitudinal conduit angle 566 is between 60° and 90° to direct the drilling fluid to a particular feature of the bit. In some embodiments, each of the fluid conduits 536 may have the same longitudinal conduit angle 566. In some embodiments, different fluid conduits 536 may have different conduit angles 566.

Figure 6:
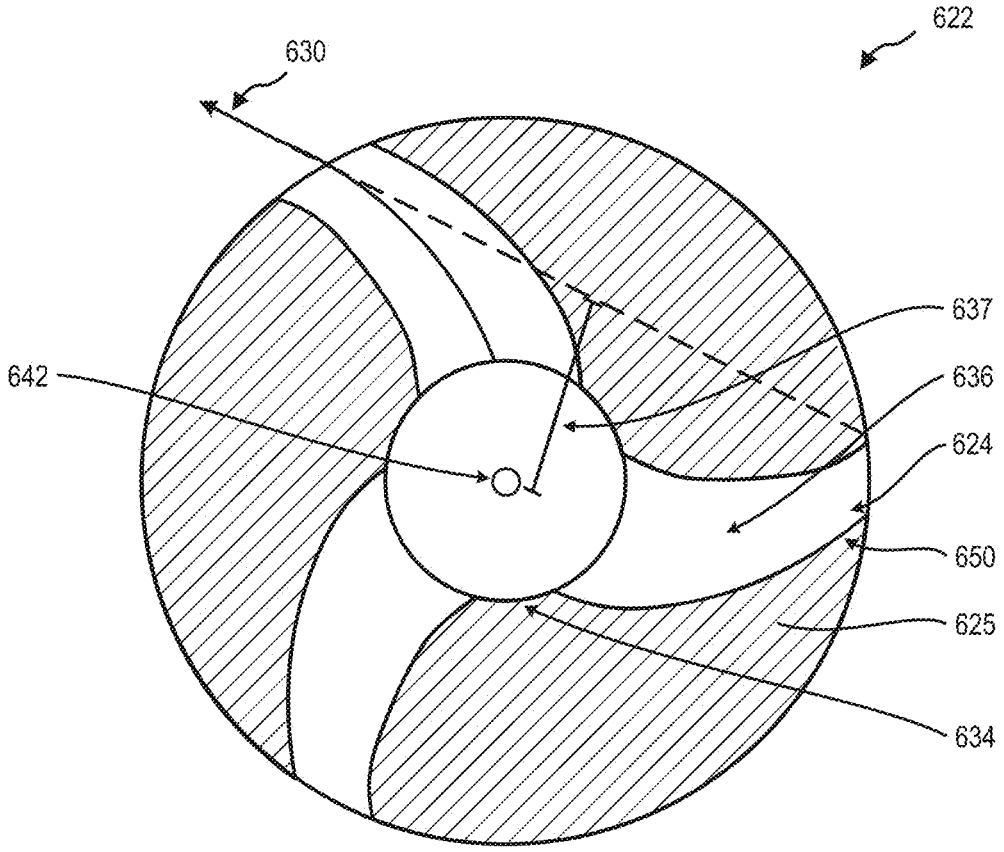
FIG. 6 is cross-sectional view of a representation of a cleaning cutting element, according to at least one embodiment of the present disclosure.

FIG. 6 is cross-sectional view of a representation of an example cleaning element 622, according to at least one embodiment of the present disclosure. The cleaning element 622 may illustrate features of either a cleaning cutting element (e.g., including a conical cutting element) or a cleaning element (e.g., without a conical cutting element) as described herein. For example, the cleaning element 622 may include a substrate 625 and an ultrahard layer joined to the substrate 625. The cleaning element 622 may not include an ultrahard layer joined to the substrate 625. The substrate 625 includes a substrate bore 634 passing at least partially therethrough. As discussed herein, drilling fluid may pass into the substrate bore 634 through an inlet in fluid communication with a fluid passage in the body of the bit. The drilling fluid may be diverted to the fluid conduits 636 at a junction 642 between the substrate bore 634 and the fluid conduits 636. The drilling fluid may pass out of the substrate 625 through the exit openings 624 of the fluid conduits 636 exiting out of a circumferential wall 650 of the substrate 625.

In accordance with at least one embodiment of the present disclosure, the cleaning element 622 may include one or more fluid conduits 636 that are not straight. For example, as may be seen in FIG. 6, the cleaning element 622 may include a fluid conduit 636 that is curved between the substrate bore 634 and the circumferential wall 650. Put another way, the fluid conduit 636 may have a curved profile. A curved fluid conduit 636 may help to orient the drilling fluid that exits the exit openings 624 to be directed to a particular feature of the bit.

In some embodiments, the curved profile of the fluid conduit 636 may facilitate orienting a flow from the fluid conduit 363 such that, as the flow exits the exit openings 624, it is directed in a direction that is offset, not aligned, or not coincident with a central (e.g., longitudinal) axis of the cleaning element 622, as described herein. For example, a flow 630 of drilling fluid may flow from an exit opening 624 in a flow direction. The flow direction may be in a direction that is not aligned with a center or central axis of the cleaning element 622. For example, the flow direction of the flow 630 may be offset by an offset distance 637 such that the flow direction is not coincident with the central axis of the cleaning element 637. The flow direction being offset in this may facilitate directing the flow 630 at one or more features of the bit, such as in a direction that is parallel, convergent, or otherwise non-divergent to one or more blades of the bit, as described herein.

Figure 7:
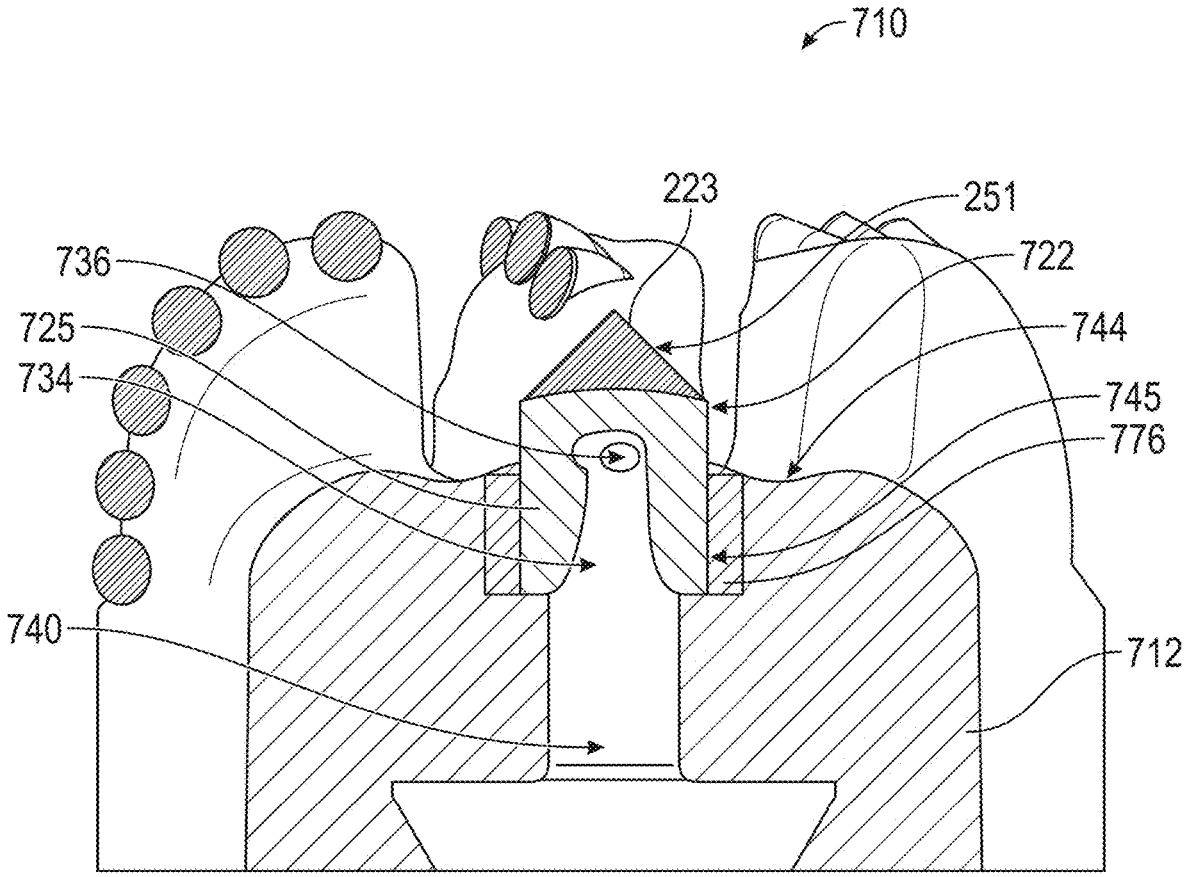
FIG. 7 is a longitudinal cross-sectional view of a bit having a cleaning cutting element secured to a body thereof, according to at least one embodiment of the present disclosure.

FIG. 7 is a longitudinal cross-sectional view of a bit 710 having a cleaning cutting element 722 secured to a body 712 thereof, according to at least one embodiment of the present disclosure. The cleaning cutting element 722 may include a substrate bore 734 formed in a substrate 725 and extending at least partially therethrough. The substrate bore 734 may be in fluid communication with a fluid passage 740 through the body 712. The substrate bore 734 may direct the drilling fluid to one or more fluid conduits 736. The fluid conduits 736 may direct the drilling fluid to one or more features of the bit 710.

The body 712 may include a cutting element pocket 745 formed in a downhole surface 744 of the body 712. In accordance with at least one embodiment of the present disclosure, the cleaning cutting element 722 may be secured to the body 712 with a sleeve 776. For example, the cleaning cutting element 722 may be brazed to the sleeve 776. The sleeve 776 may be secured to the body 712 at the cutting element pocket 745. For example, the sleeve 776 may be secured to the body 712 with a weld, an interference fit, a press fit, a mechanical fastener, any other connection mechanism, and combinations thereof. In some embodiments, the sleeve 776 may be made of the same material as the substrate of the cleaning element. In some embodiments, the sleeve 776 may be formed from any other material, such as hardened tool steel. In some embodiments, the sleeve 776 may be formed from a sacrificial part to be replaced when the bit 210 is going through repair.

In some embodiments, the body 712 of the bit 710 and the material of the substrate 725 may have different coefficients of thermal expansion. This may cause the body 712, and the cutting element pocket 745 in the body 712, to expand at a different rate than the substrate 725. When the body 712 and the substrate 725 cool down, the cutting element pocket 745 may change shape at a greater or lesser rate than the substrate 725, thereby prohibiting the connection between the substrate 725 and the body 712. For example, if the body 712 has a larger coefficient of thermal expansion than the substrate 725, the cutting element pocket 745 may shrink and damage the substrate 725 during the brazing and/or cooling process. In some examples, if the body 712 has a smaller coefficient of thermal expansion than the substrate 725, then the connection between the substrate 725 and the cutting element pocket 745 may be loose after the substrate 725 and the body 712 cool down.

To improve the connection between the substrate 725 and the body 712, the substrate 725 may be secured to the sleeve 776. The sleeve 776 may be independently secured to the cutting element pocket 745 of the body 712. This may help to reduce the mismatch of the coefficients of thermal expansion, thereby improving the connection between the substrate 725 and the body 712.

Figures 1, 8:
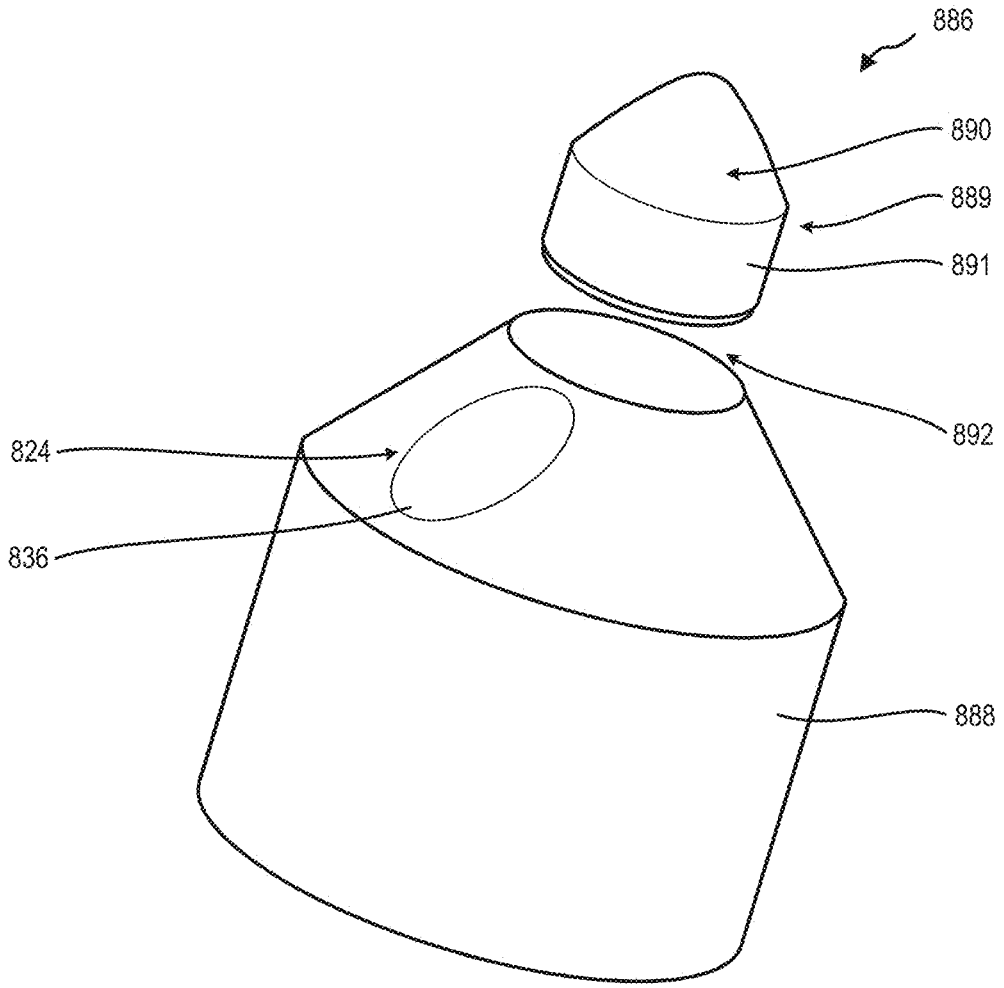
Figures 2, 8:
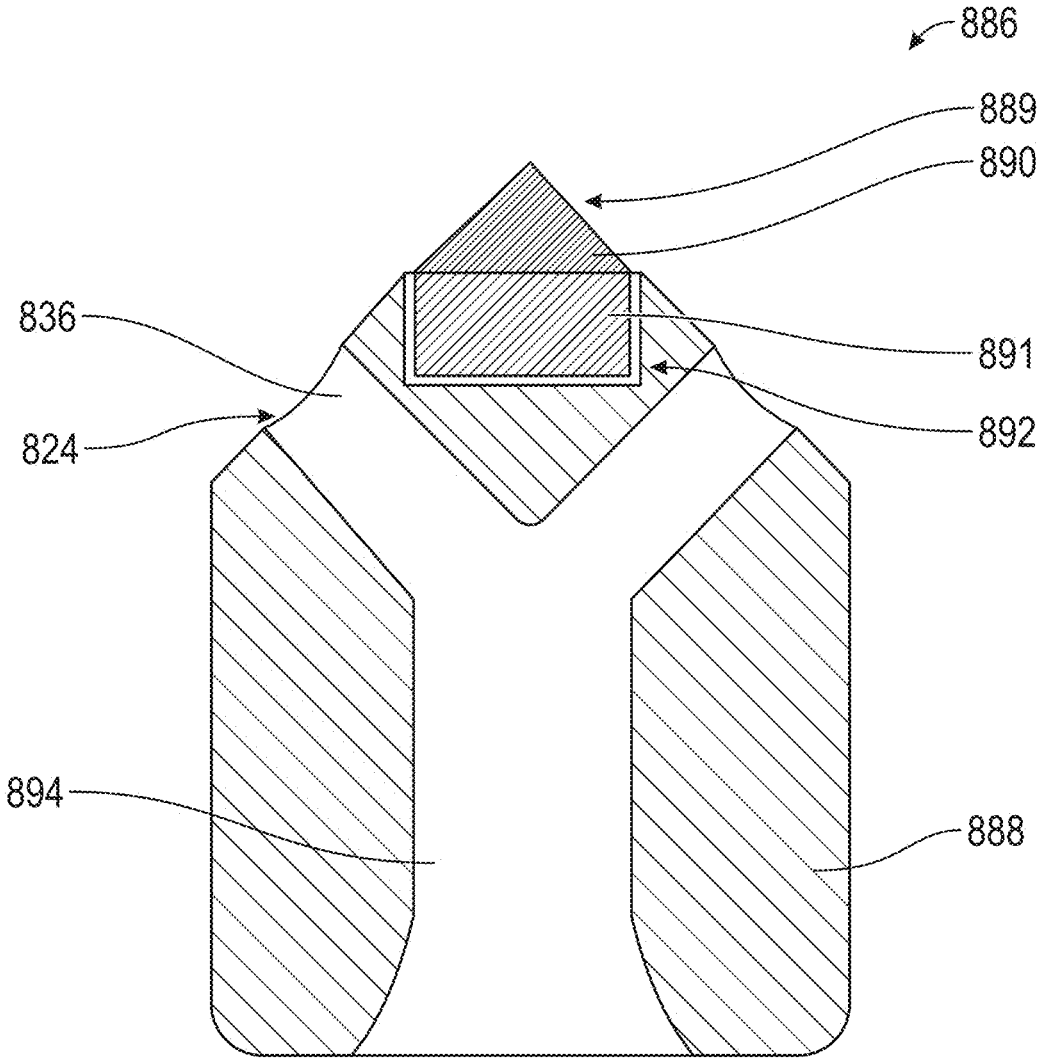

FIG. 8-1 is a perspective exploded view of a cleaning cutting system 886, according to at least one embodiment of the present disclosure. The cleaning cutting system 886 includes a cleaning base 888 and a cutting ultrahard layer 890. The cleaning base 888 may include an ultrahard layer pocket 892. The cutting ultrahard layer 890 may be secured to the cleaning base 888 in the ultrahard layer pocket 892. The cleaning base 888 may further include one or more fluid conduits 836 that exit the cleaning base 888 at an exit opening 824.

In accordance with at least one embodiment of the present disclosure, the cleaning base 888 may be secured to a cutting element pocket (e.g., cutting element pocket 245 of FIG. 2-4) in a central region of a bit (e.g., bit 210). The cutting ultrahard layer 890 may be secured to the cleaning base 888 at the ultrahard layer pocket 892. Utilizing a separate cutting ultrahard layer 890 and cleaning base 888 may help to improve the flexibility and/or the versatility of the bit. For example, the cleaning base 888 may be formed separately from the cutting ultrahard layer 890. This may allow the cleaning base 888 to include different and/or more complex internal geometries of the one or more fluid conduits 836 than may be possible in the substrate of the cutting ultrahard layer 890. In some embodiments, utilizing a separate cutting ultrahard layer 890 and cleaning base 888 may allow the drill manufacturer to utilize a cutting ultrahard layer 890 that is located in inventory or is otherwise readily available.

FIG. 8-2 is a cross-sectional view of the cleaning cutting system 886 of FIG. 8-2 in an assembled configuration. In the embodiment shown, the cutting ultrahard layer 890 is secured to the cleaning base 888 at the ultrahard layer pocket 892. For example, the cutting ultrahard layer 890 may be brazed, welded, or otherwise connected to the cleaning base 888 at the ultrahard layer pocket 892. In the embodiment shown, the cleaning base 888 includes a base bore 894 that is in fluid communication with the fluid passage of a bit. Drilling fluid from the fluid passage of the bit may enter the base bore 894, be diverted to the one or more fluid conduits 836 and out of the cleaning base 888 through the exit opening 824. As discussed herein, the cleaning base 888 may increase the flexibility of the bit, including the flexibility of the placement and/or orientation of the one or more fluid conduits 836 and/or exit opening 824 in the cleaning base 888.

Figure 9:
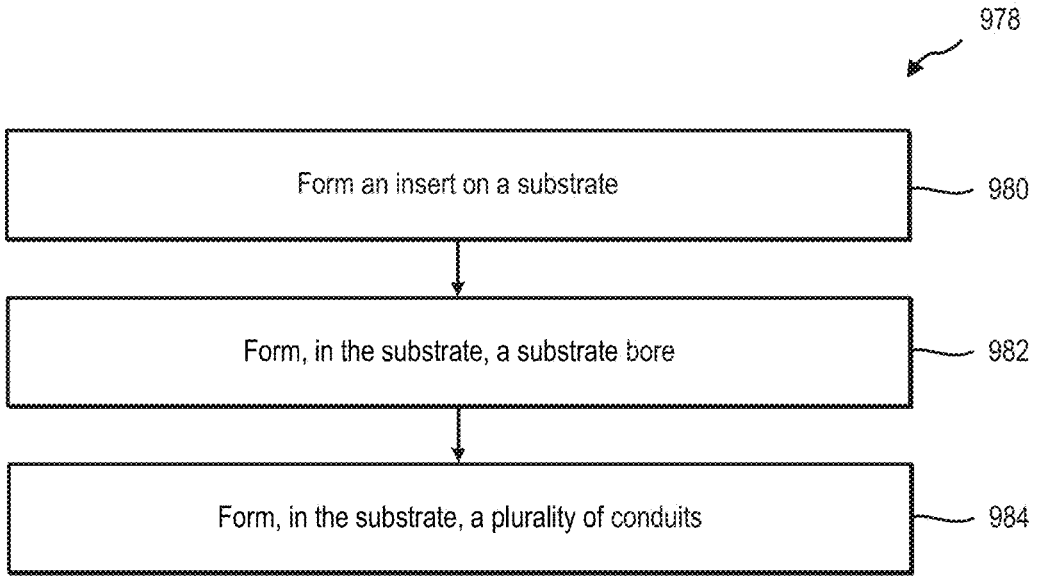
FIG. 9 is a flowchart of a method for forming a cutting element, according to at least one embodiment of the present disclosure.

FIG. 9 is a representation of a method 978 for forming a cutting element, according to at least one embodiment of the present disclosure. The method may include forming an ultrahard layer on a substrate at 980. As discussed herein, forming the ultrahard layer on the substrate may include forming an ultrahard material ultrahard layer directly on a matrix material forming the substrate.

The operator may form, in the substrate, a substrate bore at 982. The substrate bore may extend from an inlet at a bottom surface of the substrate to a junction proximate the ultrahard layer. The operator may form, in the substrate, a plurality of conduits at 984. The conduits may extend from the junction to a circumferential wall of the body of the substrate.

In some embodiments, forming the substrate bore and forming the conduits includes additively manufacturing the substrate layer by layer around the substrate bore and the conduits. In some embodiments, the operator may secure a deflector at the junction between the substrate bore and the conduits.

Figures 1, 10:
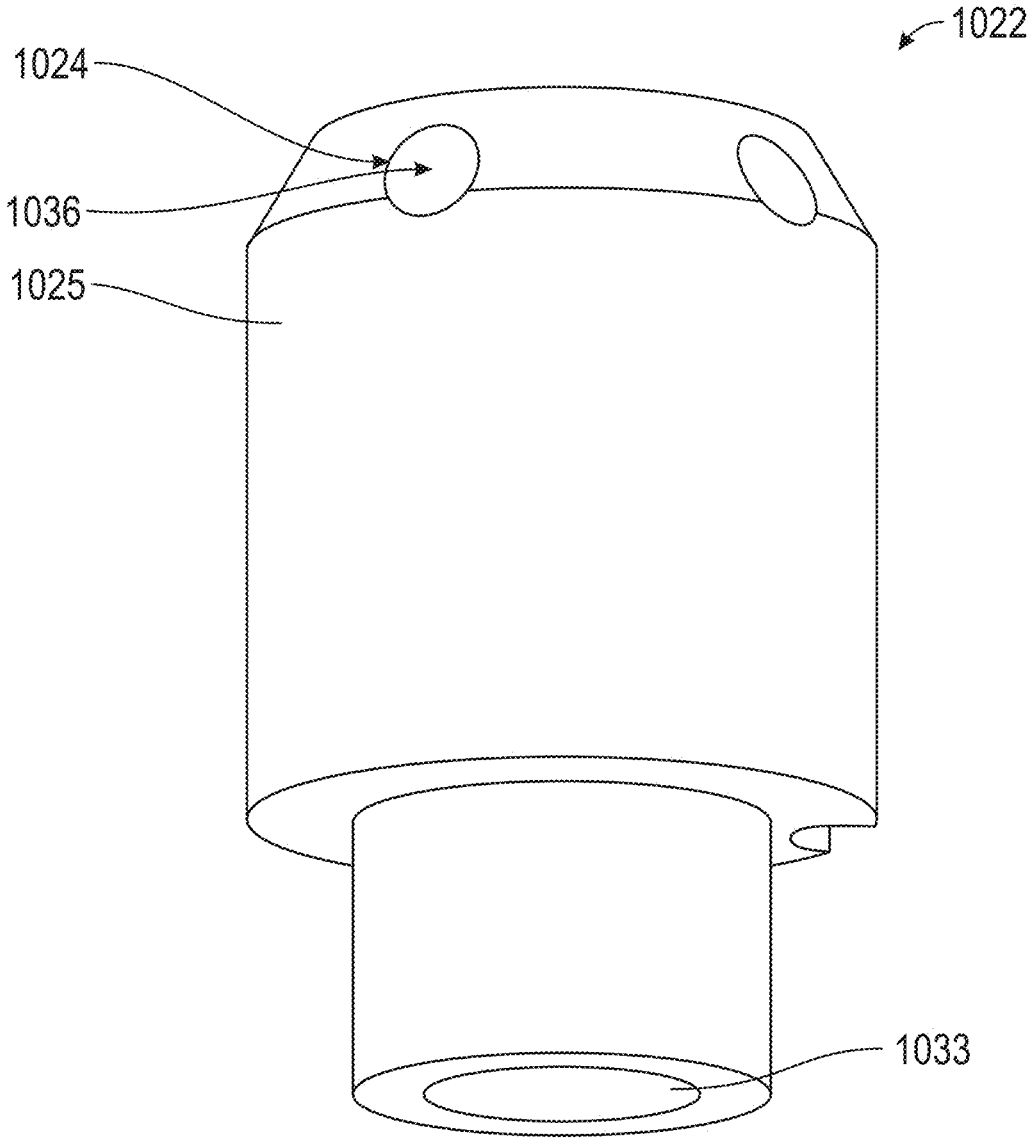
Figures 2, 10:
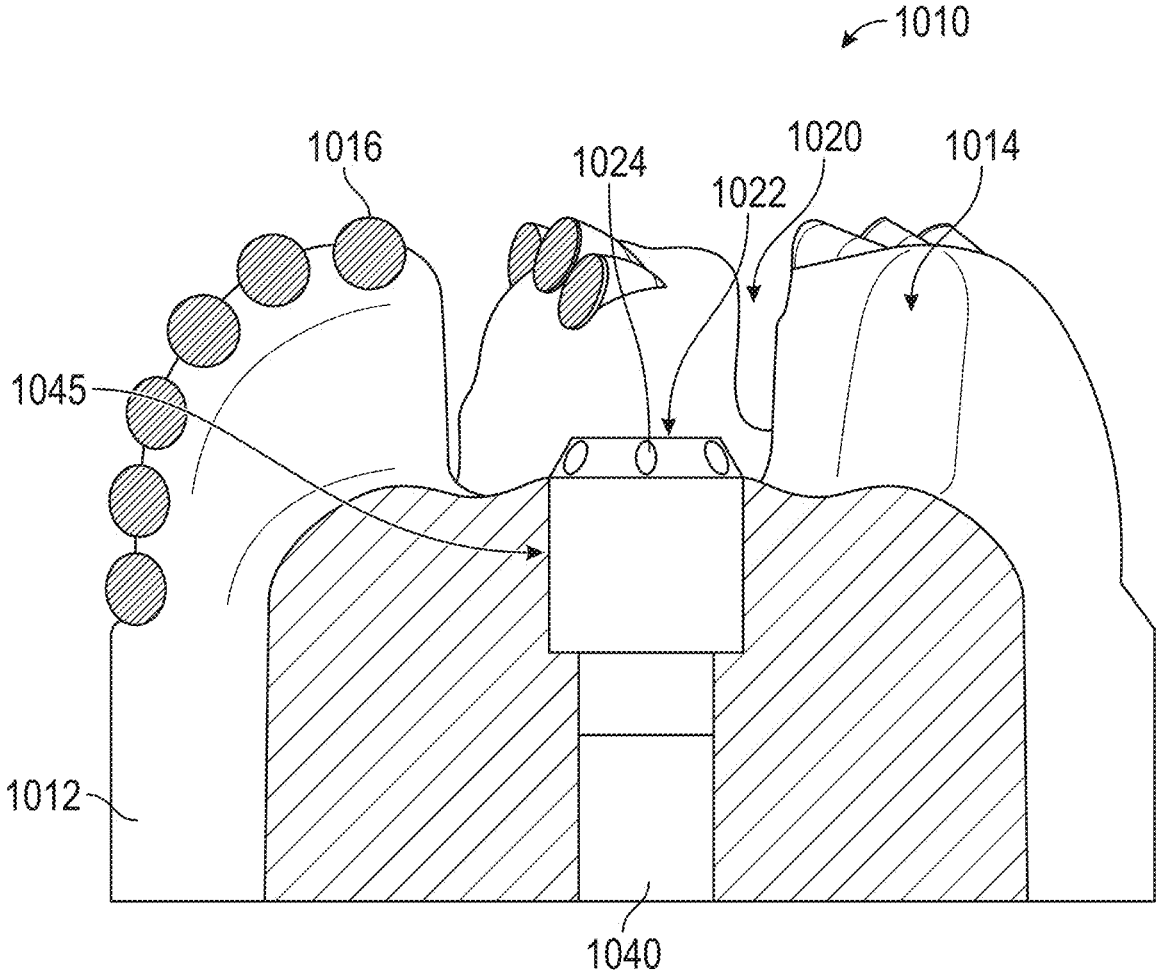

FIG. 10-1 is a side view of a representation of a cleaning element 1022, according to at least one embodiment of the present disclosure. FIG. 10-2 is a side cross-section view of a representation of the cleaning element 1022 implemented in a downhole tool 1010. The cleaning element 1022 may include any of the features and/or may preform any of the functionalities of one or more of the embodiments of the cleaning cutting element(s) described herein. For example, the cleaning element 1022 may be insertable and/or connectable to downhole tool, such as a bit. The cleaning element 1022 may facilitate provide one or more flows of a drilling fluid to the downhole tool 1022 in order to cool the downhole tool 1022, remove cuttings, etc. The cleaning element 1022 may include a body and may be formed of a substrate 1025.

In some embodiments, the cleaning element 1022 does not include an ultrahard layer (e.g., PDC cutting element) joined or formed on a top portion of the substrate 1025, such as that described in connection with the cleaning cutting elements above. For example, the cleaning element 1022 may not include an ultrahard layer such that the cleaning element 1022 may not be configured to specifically degrade the formation. In some examples, the upper surface of the cleaning element 1022 may be formed from the same material as the substrate 1025 or the body of the cleaning element 1022. In another example, the cleaning element 1022 may not be configured to engage the formation, and one or more portions of the bit may be positioned to overhang the cleaning element, as described below in further detail.

In some embodiments, the cleaning element 1022 may be configured to at least partially engage the formation and may include one or more coring features for breaking a formation core. In this way, the cleaning element 1022 may include or exhibit any of the features of the cleaning cutting element(s) described herein, but in some embodiments may not include an ultrahard portion (e.g., a cutting element) for contributing to the degrading of the formation.

In some embodiments, the substrate 1025 includes one or more fluid conduits 1036 that exit the body of the substrate 1025 at exit openings 1024. The substrate 1025 may include a substrate bore 1033 extending at least partially therethrough. The substrate bore 1033 may be configured to connect to and fluidly communicate with a fluid passage 1040 of the downhole tool 1010 to receive a flow of a drilling fluid to the substrate bore 1033. The fluid conduits 1036 may connect to the substrate bore 1033 such that fluid that is received to the substrate bore 1033 may flow through the fluid conduits 1036 and may exit the substrate 1025 through the exit openings 1024. The cleaning element 1022 in this way may be similar to the features and/or geometry of the cleaning cutting elements as discussed herein.

In some embodiments, the cleaning element 1022 may be assembled in the downhole tool 1010 through an outer surface of the downhole tool 1010. For example, the downhole tool 1010 may include a cleaning element pocket 1045 formed within a body 1012 of the downhole tool 1010. The cleaning element 1022 may be assembled in the downhole tool 1010 by inserting the cleaning element 1022 into the cleaning element pocket 1045, for example, through a top, outer surface of the downhole tool 1010 (e.g., "top" as illustrated in FIG. 10-2, or the downhole end of the downhole tool 1010). The cleaning element 1022 may be secured in the cleaning element pocket 1045 in any of the ways described herein with respect to the cleaning cutting element (s). For example, the cleaning element 1022 may be secured through a weld, braze, mechanical fastener, interference or friction fit, any other connection mechanism, and combinations thereof.

The cleaning element 1022 may be assembled with the downhole tool 1010 in this way in order to provide a flow of drilling fluid to or at one or more features of the downhole tool 1010. For example, as shown, the exit openings 1024 may be positioned above the top and/or outer surface of the downhole tool 1010. The exit openings 1024 may facilitate directing one or more flows of cleaning fluid out of the cleaning element 1022 and at one or more features of the downhole tool 1010. For example, the cleaning element 1022 may direct drilling fluid at, toward, and/or with respect to one or more blades 1014, junk slots 1020 between blades 1014, cutting elements 1016, or any other feature, and combinations thereof. In this way, the cleaning element 1022 may facilitate providing the cooling and/or cuttings removal features (or any other feature) discussed herein with respect to the cleaning cutting element(s), but may not specifically include an ultrahard layer and/or cutting element for engaging and/or degrading the formation.

Figures 1, 11:
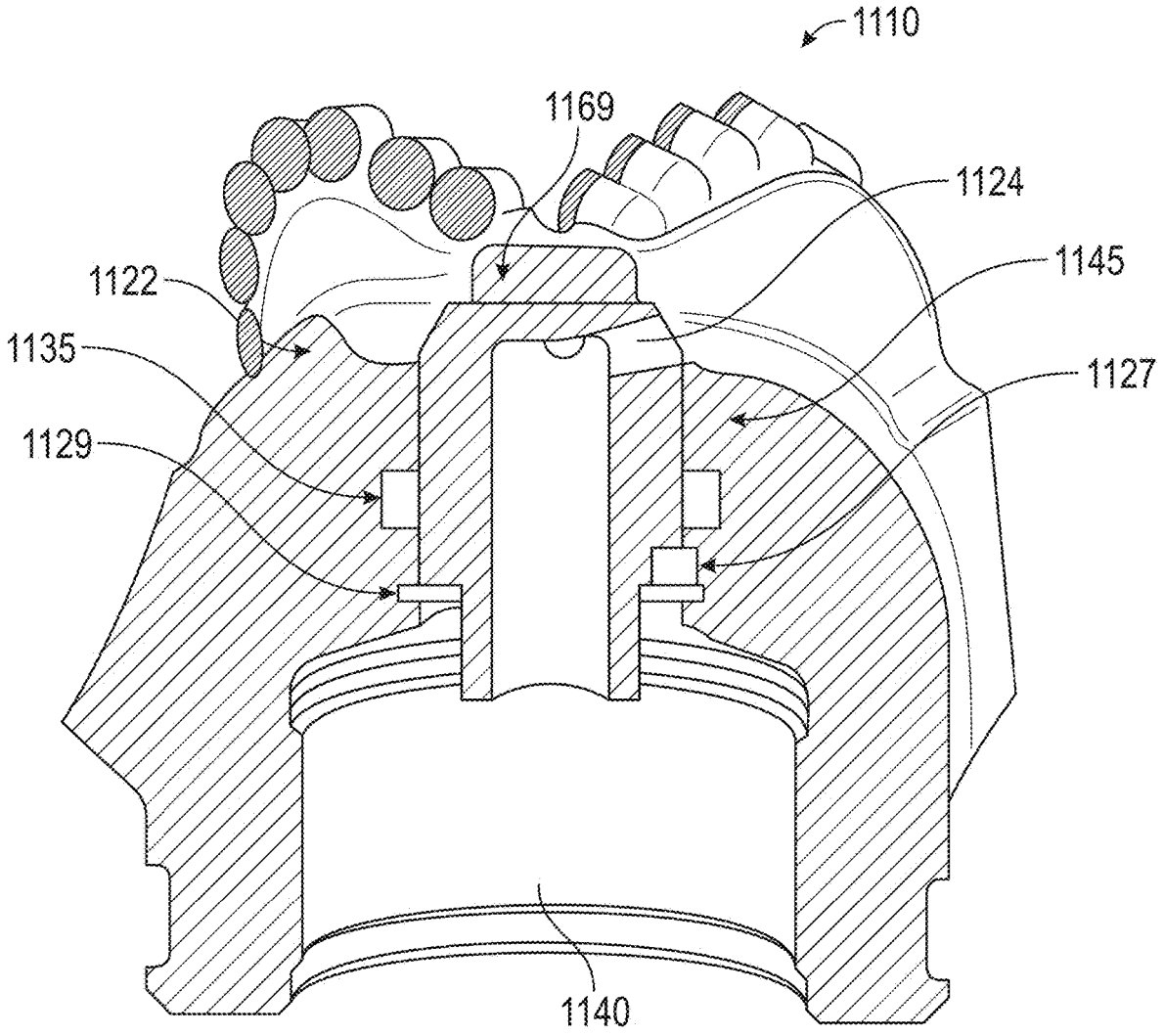
Figures 2, 11:
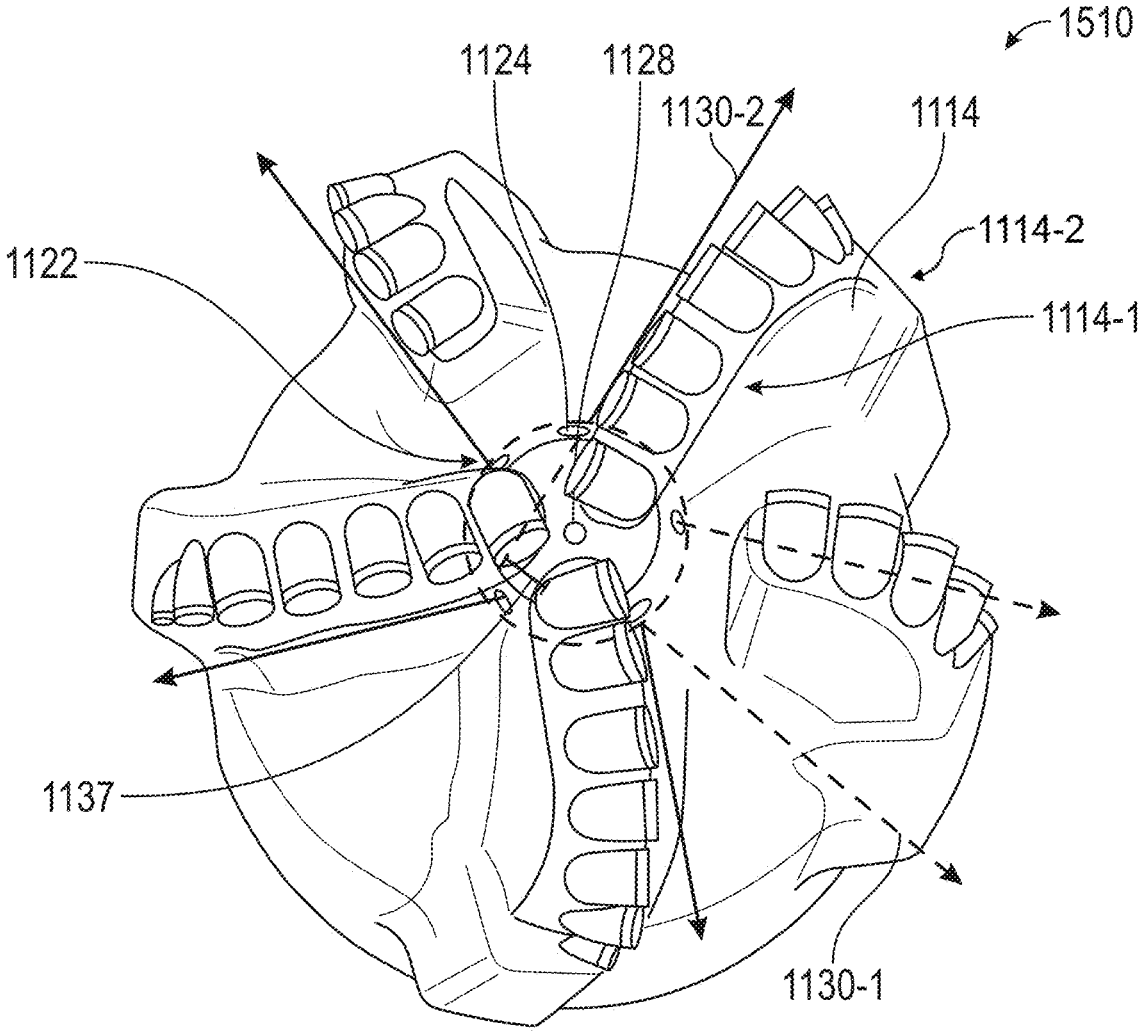

FIG. 11-1 is a side cross-section view of a representation of a cleaning element 1122 implemented in a downhole tool 1110, according to at least one embodiment of the present disclosure. In some embodiments, the cleaning element 1122 may be assembled with the downhole tool 1110 through an inside surface or inner bore of the downhole tool 1110. For example, a cleaning element pocket 1145 may be formed in the downhole tool 1110 from the inside of the downhole tool 1110, and the cleaning element 1122 may be inserted into the cleaning element pocket 1145 at or through a fluid passage 1140 of the downhole tool 1110. The cleaning element pocket 1145 may include one or more retention features or retention mechanisms to retain the cleaning element 1122 within the cleaning element pocket 1145. The retention features may prevent the cleaning element 1122 from passing out of the cleaning element pocket 1145 in any direction. For example, the retention features may prevent the cleaning element 1122 from passing out of the downhole surface of the downhole tool 1110 (e.g., upward as depicted in FIG. 11) through the downhole tool 1110 such that the cleaning element 1122 may be retained within the downhole tool 1110. In some examples, the retention features may prevent the cleaning element 1122 from passing out of the uphole surface of the downhole tool 1110 (e.g., downward as depicted in FIG. 11).

The cleaning element pocket 1145 may extend at least partially through the downhole tool 1110 such that one or more exit openings 1124 in the cleaning element 1122 extend and/or are exposed above a top or outer surface of the downhole tool 1110. In this way, the cleaning element 1122 may provide one or more flows of drilling fluid to one or more features of the downhole tool 1110 as described herein. In some embodiments, the cleaning element 1122 is partially or completely covered (e.g., at a top portion) by a bridge 1169 of the downhole tool 1110. For example, one or more blades, support structures, or substrate of the downhole tool 1110 may contact or join to form the bridge 1169. The bridge 1169 may at least partially (or completely) cover a top portion of the cleaning element 1122, as shown in FIG. 11. In this way, the cleaning element 1122 may be at least partly protected from the downhole environment by the bridge 1169, such as by preventing contact or engagement of the cleaning element 1122 with a formation.

In some embodiments, the cleaning element 1122 is at least partly (or completely) exposed at the top of the cleaning element 1122. For example, while the cleaning element 1122 may insert into the cleaning element pocket 1245 through an inside of the downhole tool 1110, some or all of the top of the cleaning element 1122 may extend upward past an exterior or outer surface of the downhole tool 1110. For example, the cleaning element 1122 may not be covered and/or protected by, for example, a blade of the downhole tool 1110. As discussed in further detail below, in some embodiments, some of the downhole tool 1110 (e.g., a blade) may partly overhang the cleaning element 1122 such that the cleaning element may be partly covered and/or protected, and may partly be exposed (e.g., to the formation). In this way, implementations of the cleaning element 1122 (e.g., inserted through an inside of the downhole tool 1110) may include the cleaning element 1122 being partly or substantially covered, as well as partly or substantially exposed to the exterior environment.

In some embodiments, the cleaning element 1122 may be secured in the cleaning element pocket 1145. The cleaning element 1122 may be secured with a permanent or semi-permanent connection, such as through a weld, braze, press fit or other interference fit, any other connection mechanism, and combinations thereof. In some embodiments, the cleaning element 122 is secured in the cleaning element pocket 1145 through a mechanical connection. For example, the cleaning element 1122 may be secured with a retention element 1129. The retention element 1129 may be a ring, clip, pin, or any other mechanical means for retaining the cleaning element 1122. The cleaning element 1122 and/or the cleaning element pocket 1145 may include one or more associated features or geometries for mating with the retention element 1129, such as a groove, slot, gland, etc. As shown in FIG. 11, the cleaning element 1122 may be secured with a retention ring that fits and/or mates with grooves in the cleaning element pocket 1145 and/or cleaning element 1122. In this way, the cleaning element 1122 may be secured in the downhole tool 1110 through a mechanical connection.

In some embodiments the fluid passage 1140 may be sealed to prevent drilling fluid from flowing out of the downhole tool 1110, for example, through the cleaning element pocket 1145. For example, a seal 1135 may be positioned between the cleaning element 1122 and the cleaning element pocket 1145. The seal 1135 may be an O-ring or washer such as a rubber, silicone, plastic, or metal O-ring (or any other suitable material). The seal 1135 may be implemented as mating sealing surfaces of the cleaning element 1122 and/or the cleaning element pocket 1145. In this way, the seal 1135 may prevent unwanted drilling fluid from passing through the cleaning element pocket 1145 to an exterior of the downhole tool 1110.

In some embodiments, the cleaning element 1122 may be oriented and/or positioned in a particular direction or orientation. For example, the exit openings 1124 may be configured to be positioned in a precise direction and/or location in order that they may effectively provide the drilling fluid to the features of the downhole tool 1110 as described herein. In some embodiments, a key 1127 may oriented the positioning of the cleaning element 1122. For example, the key 1127 may be a pin, that mates with features of the cleaning element 1122 and/or the cleaning element pocket 1145 such that the cleaning element 1122 remains in a desired orientation with respect to the downhole tool 1110.

In some embodiments, the mechanical connection may facilitate the cleaning element 1122 being removably connected to the downhole tool 1110. For example, the cleaning element 1122 may be removable for maintenance or for different configurations of the downhole tool 1110. While the mechanical connection of the cleaning element 1122 has been primarily described with respect to insertion of the cleaning element 1122 through the inside of the downhole tool 1110, it should be understood that the same or similar mechanical connection may be implemented with respect to a cleaning element that is insertable through a top or outer surface of the downhole tool 1110.

FIG. 11-2 is a top view of the cleaning element 1122 implemented in the downhole tool 1110, according to at least one embodiment of the present disclosure. As mentioned above, the cleaning element 122 may include one or more exit openings 1124 through which a drilling fluid may flow to or towards one or more features of the downhole tool 1110. The cleaning element 1122 being positioned substantially centrally in the downhole tool 1110. For example an a central or longitudinal axis of the cleaning element 1122 and a central or longitudinal axis of the downhole tool 1110 may be coaxial. The cleaning element 1122 being centrally located in this way may facilitate the drilling fluid flowing substantially from the center or a central portion of the downhole tool 1110 and toward one or more features of the downhole tool 1110. This centrally originating flow of drilling fluid may help to increase the fluid flow through the downhole tool 1110, which may help to flush cuttings away from a center region of the downhole tool 1110, help flush cuttings out of the junk slots 1120, increase cooling on one or more features of the downhole tool 1110, perform any other action, and combinations thereof.

In some embodiments, the flow of the drilling fluid may be represented by a first flow 1130-1. An exit opening 1124 may direct the first flow 1130-1 of the drilling fluid in a first flow direction. The first flow direction may be substantially a radial direction (e.g., perpendicular to the longitudinal axis 1128). For example, the first flow 1130-1 may be a perpendicular flow that flows from the exit opening 1124 at a substantially perpendicular angle to the cleaning element 1122. For instance, the first flow 1130-1 may flow in a first flow direction that is coincident with, intersects, originates from, is not offset from, or is otherwise aligned with a central axis or longitudinal axis 1128 of the downhole tool 1110 and/or the cleaning element 1122, as shown in FIG. 11-2.

In some embodiments, the flow of the drilling fluid may be represented by a second flow 1130-2. An exit opening 1124 may direct the second flow 1130-2 of the drilling fluid in a second flow direction that is not a directly radial direction. The second flow 1130-2 may be a transverse flow that flows from an exit opening 1124 in a second flow direction that is transverse and/or not perpendicular to the cleaning element 1122. For example, the second flow 1130-2 may flow in a second flow direction that is not coincident, is offset, does not intersect, or is otherwise not aligned with the longitudinal axis 1128. For instance, the second flow direction of the second flow 1130-2 may be characterized by an offset distance 1137 from the longitudinal axis 1128.

The offset nature of the second flow 1130-2 may facilitate directing the second flow 1130-2 at or towards one or more features of the downhole tool 1110. For example, the offset 1137 of the second flow 1130-2 may facilitate directing the second flow 1130-2 toward a blade 1114 of the downhole tool 1110. The second flow 1130-2 may be substantially parallel to the blade 1114, or substantially parallel to at least a portion of the blade 1114. For example, the second flow 1130-2 may be substantially parallel to an inner portion 1114-1 of the blade that is located rotationally toward the center of the downhole tool 1110. In some embodiments, the second flow 1130-2 may be substantially parallel to an engagement (e.g., cutting) face of the blade 1114, such as one or more cutting elements 1116 disposed thereon (e.g., disposed on the inner portion 1114-1). In some embodiments, the inner portion 1114-1 may be substantially linear and an outer portion 1114-2 may have a helical or curved shape (e.g., helical either in the direction or opposite the direction of rotation of the downhole tool 1110). In this way, the second flow 1130-2 may flow substantially parallel to at least the inner portion 1114-1, and in some cases may flow substantially parallel to most or all of the blade 1114. In some embodiments, the second flow 1130-2 may flow in a direction that is convergent with at least some of the blade 1114 and/or one or more engagement faces (e.g., cutting element 1116) of the blade 1114. For example, the second flow 1130-2 may be directed at an angle toward (e.g., convergent with) some or all of the blade 1114, such as toward or convergent with the inner portion 1114-1 of the blade. The flow 1130-2 may be convergent in that it may glow closer to some or all of the blade as it travels from the exit opening 1124.

In this way, the second flow 1130-2 may be oriented in a second flow direction that is non-divergent with respect to the blade 1114 (or a portion of the blade 1114), such as parallel or convergent to the blade 1114. For example, the second flow 1130-2 may be non-divergent in that the second flow 1130-2 does not move farther away from the blade 1114 as it travels across the downhole tool 1110. This may be in contrast to the first flow 1130-1, which, by virtue of flowing perpendicular from the cleaning element 1122, may flow across the downhole tool 1110 in a way that diverges (or moves further away) from the blades, or at the very least, diverges from the inner portions and/or inner engagement faces of the blades. In this way, the second flow 1130-2 may provide an improved flow of the drilling fluid to features of the downhole tool (e.g., blades 1114) that are positioned radially further from the center of the downhole tool 1110. For example, by not diverging from some or all of a blade 1114, the second flow 1130-2 may provide better cutting removal, cooling, etc. to portions of the blade 1114, cutting elements 1116, and/or features of the blade that are located rotationally further toward an outside of the body of the downhole tool 1110.

The cleaning element 1122 may include exit opening(s) 1124 that are directed so as to provide one or more flows of drilling fluid that exhibit the features and functionalities of the first flow 1130-1, the second flow 1130-2, or combinations thereof. For example, in some embodiments, all of the exit openings 1124 have the same type of flow direction (e.g., perpendicular or offset). In another example, different exit openings 1124 have different types of flow directions, such as some exit openings 1124 exhibiting perpendicular flow directions and some exit openings 1124 exhibiting offset flow directions.

Figure 12:
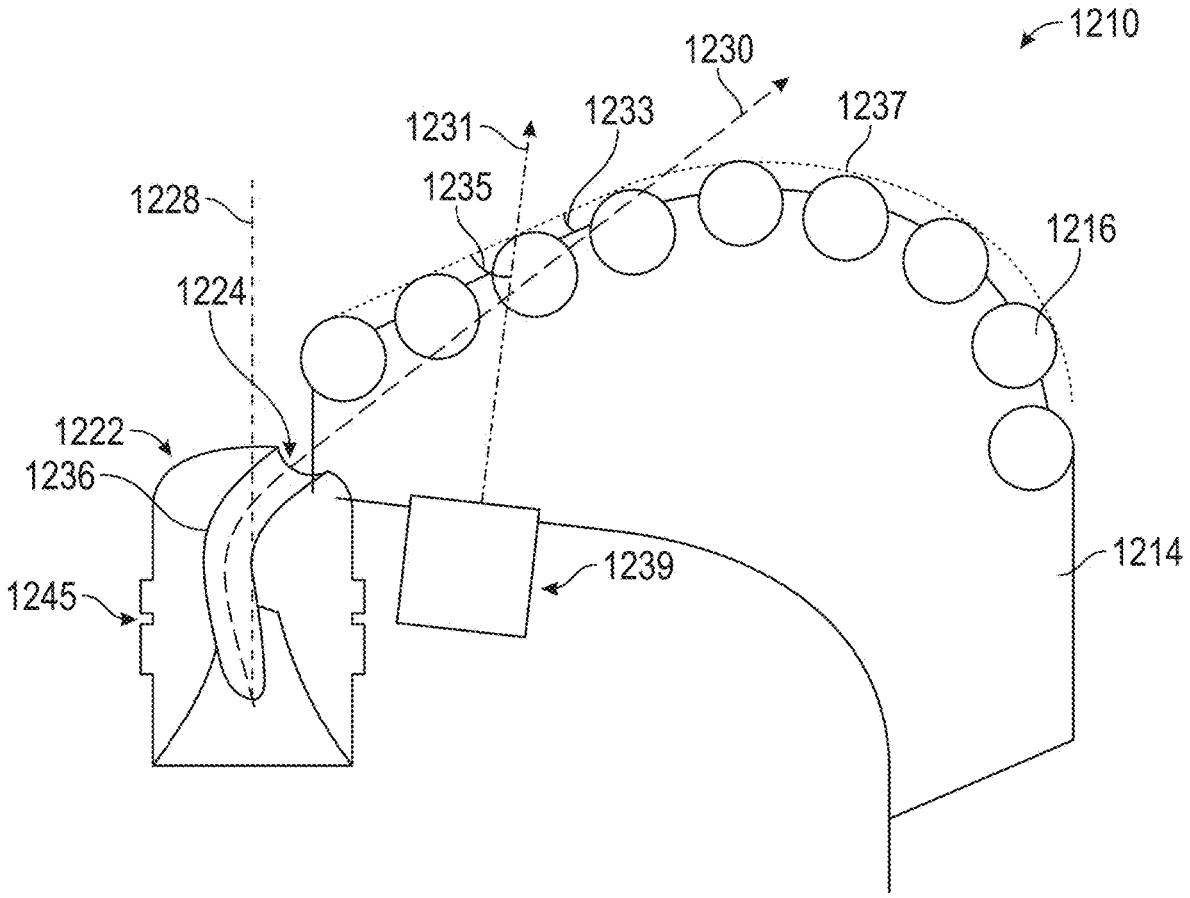
FIG. 12 is a side schematic representation of a cleaning element implemented in a downhole tool, according to at least one embodiment of the present disclosure.

FIG. 12 is a side schematic representation of a cleaning element 1222 implemented in a downhole tool 1210, according to at least one embodiment of the present disclosure. As discussed herein, the cleaning element 1222 may be implemented with the downhole tool 1210 at a central axis or longitudinal axis 1228 of the downhole tool. The cleaning element 1222 may include one or more fluid conduits 1236 and exit openings 1224 for providing one or more flows of drilling fluid from a central portion of the downhole tool 1210.

As discussed above in connection with FIGS. 11-1 and 11-2, the cleaning element may provide one or more flows of drilling fluid that may have directional aspects specifically with respect to a horizontal or top-down reference plane of the downhole tool 1210. In some embodiments, the cleaning element may (additionally or alternatively) provide the flow(s) of drilling fluid having one or more directional aspects with respect to a vertical or side reference plane of the downhole tool, as shown in FIG. 12.

The downhole tool 1210 may include one or more blades 1214 having one or more engagement surfaces thereon. The engagement surfaces may be engagement surfaces of one or more cutting elements 1216 disposed on the blades 1214 of the downhole tool 1210. The orientation and positioning of the engagement surface(s) may define an engagement profile 1237 for a blade 1214 and/or the downhole tool 1210.

In some embodiments, the cleaning element 1222 provides a flow 1230 of drilling fluid from an exit opening 1224. The flow 1230 may have a flow direction that is more aligned with the engagement profile 1237 that may be the case with a nozzle such as a junk slot nozzle 1239. For example, the junk slot nozzle 1239 is illustrated as providing an example flow 1231 of drilling fluid from the downhole tool 1210. In some embodiments, the junk slot 1239 may be a nozzle that may typically be included in a downhole tool 1210 for providing a flow of drilling fluid. The junk slot nozzle 1239 is shown as an illustrative implementation with the downhole tool 1210 and may not necessarily be implemented in the downhole tool 1210, for example, in addition to the cleaning element 1222. Alternatively, the junk slot nozzle 1239 may be included in the downhole tool 1210 in addition to the cleaning element 1222.

As shown, the flow 1230 and the example flow 1231 may each intersect with the engagement profile 1237. In some embodiments, the flow 1230 intersect the engagement profile 1237 with a flow angle 1233 that is less than an example flow angle 1235 with which the example flow 1231 intersects the engagement profile 1237. The flow angle 1233 being smaller than the example flow angle 1235 in this way facilitates the flow 1230 flowing in a more aligned direction (e.g., closer to parallel) with at least a portion of the engagement profile 1237. In some embodiments, the flow 1230 may be substantially parallel to at least a portion of the engagement profile 1237, such as a rotationally inner portion.

This aligned, or semi-aligned nature of the flow 1231 with the engagement profile 1237 may facilitate the flow 1230 interacting with and/or flowing past more of the blade 1214 (e.g., more of the cutting elements 1216) before the flow 1230 passes an outer extent of the blade 1214 and/or surpasses the engagement profile 1237. In contrast, the example flow 1231 may interact with and/or flow past a relatively small portion of the blade 1214 before surpassing the engagement profile 1237, as shown. The cleaning element 1222 in this way may facilitate the flow 1230 of drilling fluid providing cooling, cutting removal, etc., to more of the blade 1214 (e.g., to more cutting elements 1216) than is achieved with the example flow 1231 of the junk slot nozzle 1239. This improved flow angle 1233 may be facilitated by the cleaning element 1222, and the associated exit openings 1224, being located in a more central region of the downhole tool, as described herein.

In some embodiments, the flow angle is an acute angle measured with respect to the engagement profile 1237. For example, the flow angle 1233 may be in a range having an upper value, a lower value, or upper and lower values including any of 0°, 5°, 10°, 20°, 30°, 45°, 50°, 60°, or any value therebetween. For example, the flow angle 1233 may be less than 60°. In another example the flow angle 1233 may be greater than 0°. In yet another example, the flow angle 1233 may be between 0° and 60°. In some embodiments, it is critical that the flow angle 1233 be no greater than 45° in order to achieve the benefits of increased flow past some or all of the blade 1214 as described herein. In some embodiments, the flow angle 1233 may be a negative angle. For example, FIG. 12 shows the flow 1230 emanating or originating from below the engagement profile 1237 and flowing up toward the engagement profile 1237 as defined by the flow angle 1233. In some embodiments, the cleaning element 1222 may be configured and positioned such that the flow 1230 may emanate or originate from above the engagement profile 1237 and may flow down (at least somewhat) toward the engagement profile 1237. In this way the flow angel 1233 may be a negative flow angle. The flow angle 1233 may be a negative value of any of the angles and/or ranges of angles of the flow angle 1233 as discussed above. For example, the flow angle 1233 may be any value from 0° to −60°.

In some embodiments, the cleaning element(s) and/or cleaning cutting element(s) described herein may be implemented in a downhole tool that includes one or more portions, structures, or features of the downhole tool that overhangs the cleaning element and/or cleaning cutting element.

Figures 1, 13:
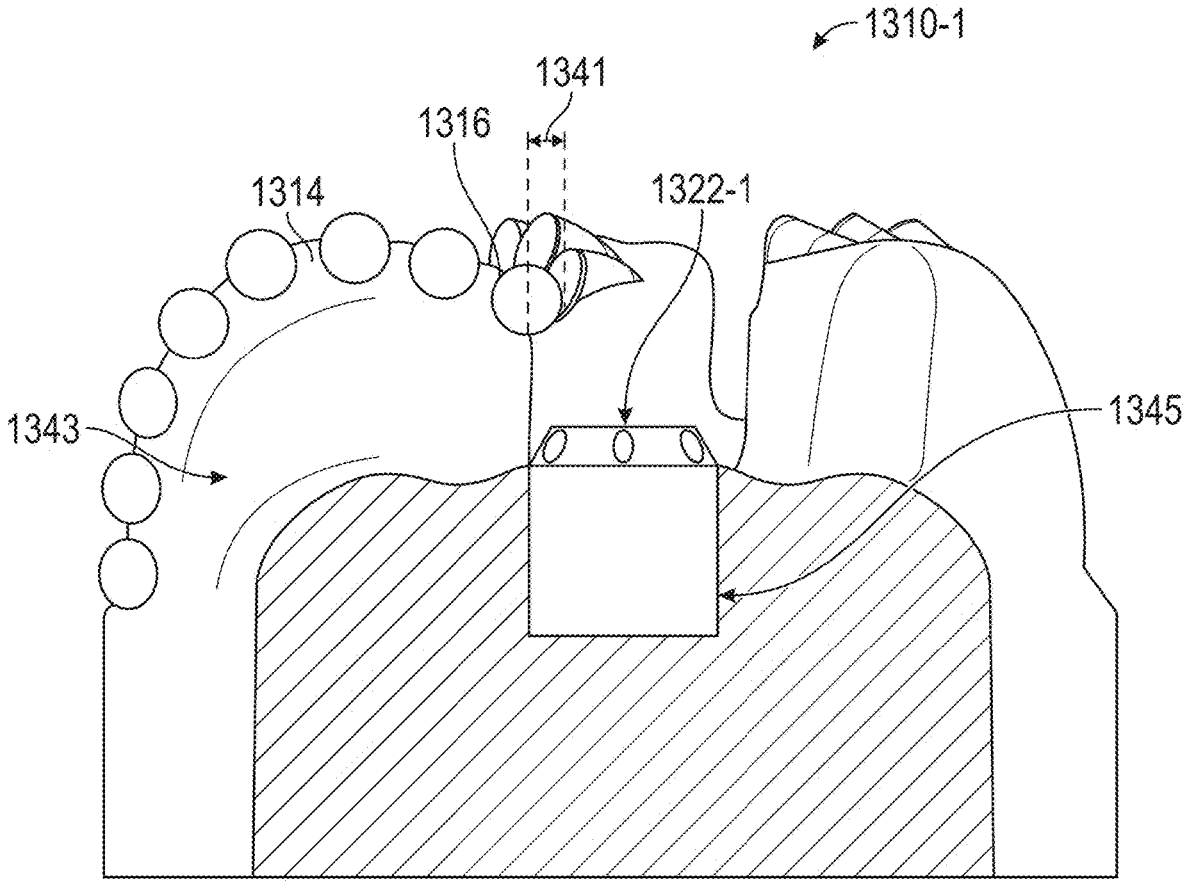
Figures 2, 13:
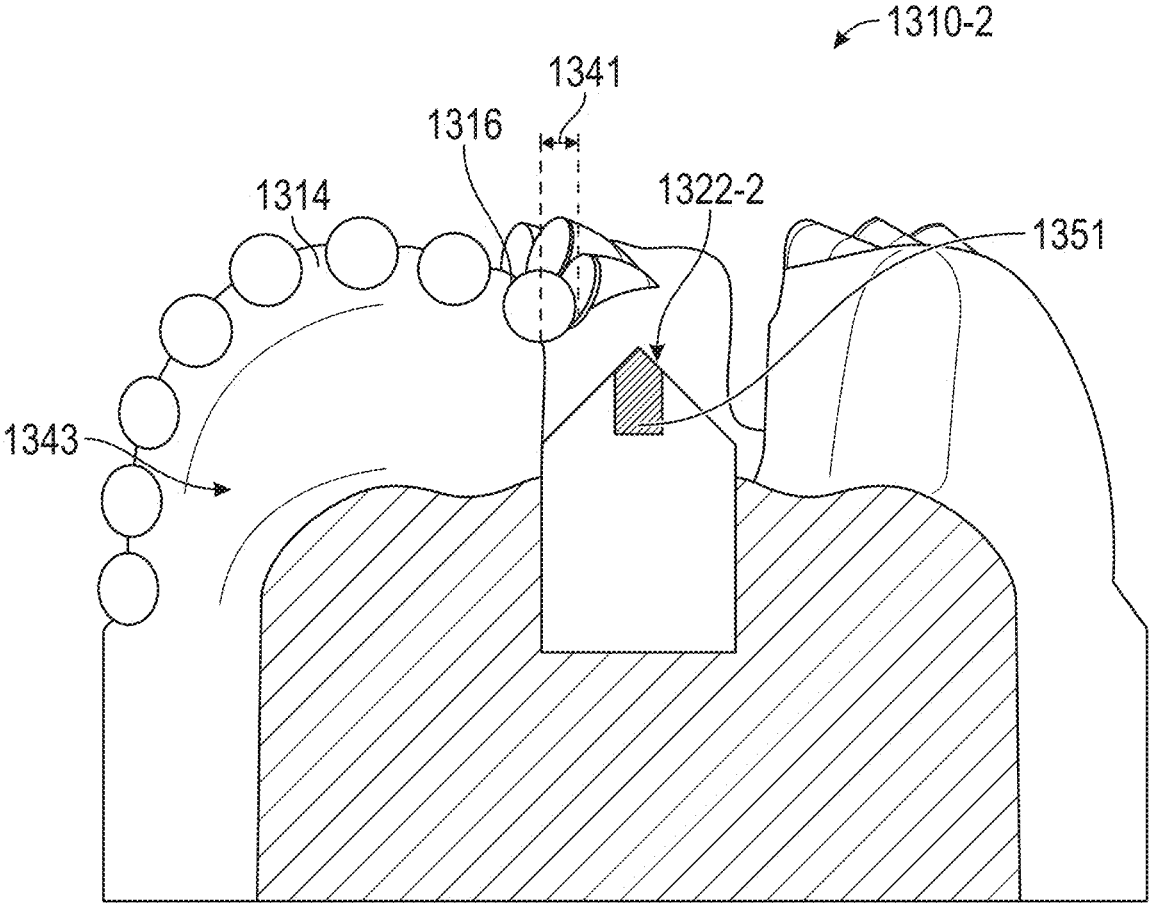

For example, FIG. 13-1 illustrates a representation of a cleaning element 1322-1 implemented in a downhole tool 1310-1, according to at least one embodiment of the present disclosure. The downhole tool 1310-1 may include one or more blades 1314 having one or more cutting elements 1316 disposed thereon.

In some embodiments, one or more of the cutting elements 1316 may be disposed on a blade 1314 with an overhang 1341. For example, the blade 1314 may include a support structure 1343 portion of the blade 1314 which may form the general shape and/or geometry of the blade 1314 as well as supporting the cutting elements 1316. The support structure 1343 may extend toward the cleaning element 1322-1 such that the support structure 1343 is close to, adjacent, or even contacting the cleaning element 1322-1. In some embodiments, the support structure 1343 may not overhang the cleaning element 1322-1. This may facilitate the cleaning element 1322-1 being inserted into a cleaning element pocket 1345, for example, in embodiments where the cleaning element 1322-1 is assembled with the downhole tool 1310-1 from an outer surface of the downhole tool 1310-1. The support structure 1343 extending toward and/or adjacent to the cleaning element 1322-1 in this way may facilitate the overhang 1341 of a cutting element 1316. For example, a cutting element 1316 may be positioned on the blade 1314 such that it is at least partially positioned vertically above at least a portion of the cleaning element 1322-1. The overhang 1341 of a cutting element 1316 in this way may at least partially cover and/or protect the cleaning element 1322-1 from exposure to and/or contact with a formation. For example, as the downhole tool 1310-1 proceeds through the formation, the cutting element 1316 may remove or degrade the portion of the formation that is in the downhole path of the cleaning element 1322-1 such that the cleaning element 1322-1 may not engage with that portion of the formation.

In some embodiments, the downhole tool 1310-1 may include two or more cutting elements 1316 that overhang the cleaning element 1322-1 (e.g., on a same blade or on two or more blades 1314) in this way. The two or more cutting elements 1316 that overhang the cleaning element 1322-1 may overhang to the same or different degrees. For example, multiple cutting elements 1316 may overhang to different degrees such that most or all of the cutting element is covered by the multiple overhanging cutting elements 1316. The overhanging of the cutting elements 1316 in this way may facilitate the downhole tool 1310-1 removing more of the formation and advantageously providing a more complete cut of the wellbore bottom hole (e.g., with a smaller or no core). This may additionally help to protect the cleaning element 1322-1 by preventing or minimizing the engagement of the cleaning element 1322-1 with the formation. In some embodiments, at least some of the cleaning element 1322-1 may be uncovered and/or exposed to the formation. For example, a central portion of the formation (with respect to the downhole tool 1310-1) may not be removed or degraded by the cutting elements 1316 such that a formation core may develop in the center of the downhole tool 1310-1 as it progresses through the formation. The cleaning element 1322-1 may include a coring feature to remove or break the formation core, as described herein.

FIG. 13-2 illustrates a representation of a cleaning cutting element 1322-2 implemented in a downhole tool 1310-2, according to at least one embodiment of the present disclosure. The cleaning cutting element 1322-2 may include an ultrahard layer (e.g., conical cutting element) disposed on a top of a substrate of the cleaning cutting element 1322-2. The downhole tool 1310-2 may include any of the features of the downhole tool 1310-1 discussed above in connection with FIG. 13-1. For example, the downhole tool 1310-2 may include one or more cutting elements 1316 with an overhang 1341 over the cleaning cutting element 1322-2. The overhang(s) 1341 of the cutting element(s) 1316 may at least partially cover the cleaning cutting element 1322-2 from exposure to a formation. The overhang 1341 of the cutting elements 1316 in this way may facilitate the downhole tool 1310-2 removing more of the formation and advantageously providing a more complete cut of the wellbore bottom hole (e.g., with a smaller or no core). This may additionally help to protect the cleaning cutting element 1322-2 by preventing or minimizing the engagement of the cleaning cutting element 1322-2 with the formation. For example, the overhang 1341 may facilitate protecting one or more portions of the cleaning cutting element 1322-2 that do not include an ultrahard layer. For example, as shown, an ultrahard layer 1351 may be disposed on a top portion of the cleaning cutting element 1322-2 but may not cover an entirety of the top surface of the cleaning cutting element 1322-2. The exposed portions of the top surface that are not ultrahard may be more susceptible to damage, wear, etc. than the ultrahard portion. The overhang 1341 may extend over at least some of these non-ultrahard portions of the cleaning cutting element 1322-2 such that they do not engage or contact the formation and becoming worn and/or damaged.

As discussed above, in some embodiments, the cleaning cutting element 1322-2 may be assembled with the downhole tool 1310-1 in a cutting element pocket 1345 by inserting the cleaning cutting element 1322-2 through an outer surface of the downhole tool 1310-2. Should the downhole tool 1310-2 overhang the cleaning cutting element 1322-2 with more than just cutting elements 1316 (e.g., were a support structure 1343 to overhang the cleaning cutting element 1322-2), the cleaning cutting element 1322-2 may be prevented from insertion into the cutting element pocket 1345 and therefore assembly with the downhole tool 1310-2. Overhanging just (e.g., one or more) cutting elements 1316 may accordingly facilitate assembly of the downhole tool 1310-2. For example, the cleaning cutting element 1322-2 may be inserted and secured into the cutting element pocket 1345 prior to one or more overhanging cutting elements 1316 being connected or inserted into a corresponding blade 1314, and after the cleaning cutting element 1322-2 is inserted and secured in the cutting element pocket 1345, the overhanging cutting elements 1316 may then be connected. In this way, one or more overhanging features may also apply to implementations of a downhole tool with a cleaning cutting element as described herein.

Figure 14:
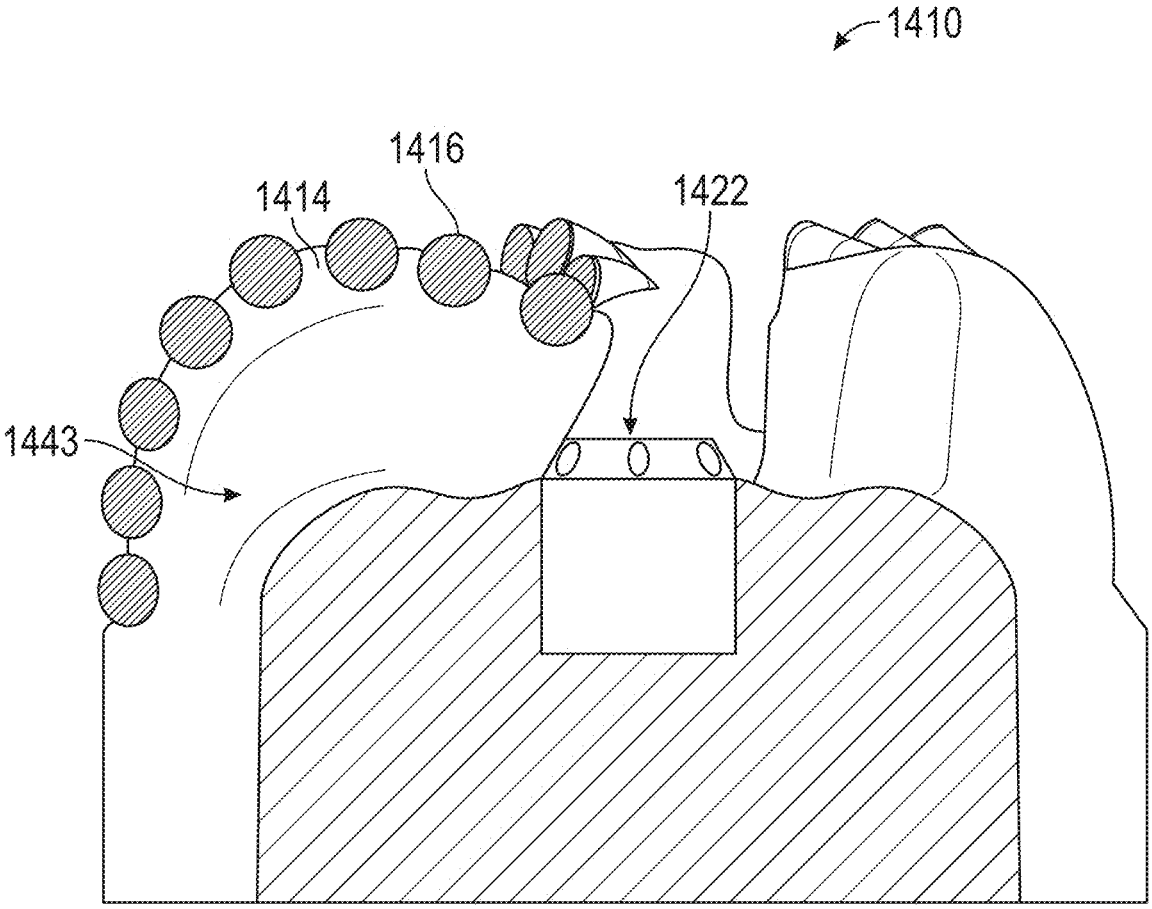
FIG. 14 illustrates a representation of a cleaning element implemented in a downhole tool, according to at least one embodiment of the present disclosure.

FIG. 14 illustrates a representation of a cleaning element 1422 implemented in a downhole tool 1410, according to at least one embodiment of the present disclosure. The downhole tool 1410 may include one or more blades 1414 having one or more cutting elements 1416 disposed thereon. In some embodiments, one or more of the blades 1414 may overhang the cleaning element 1422. For example, as shown, a support structure 1443 of the blades 1414 may extend toward and over at least a portion of the cleaning element 1422. In some embodiments, one or more cutting elements 1416 disposed on the blades 1414 may also be positioned overhanging the cleaning element 1416. The blades 1414 in this way may at least partially cover the cleaning element 1422 in order to provide a more complete cut of the bottom hole of the wellbore and/or to protect the cleaning element 1422 as discussed herein.

Figures 1, 15:
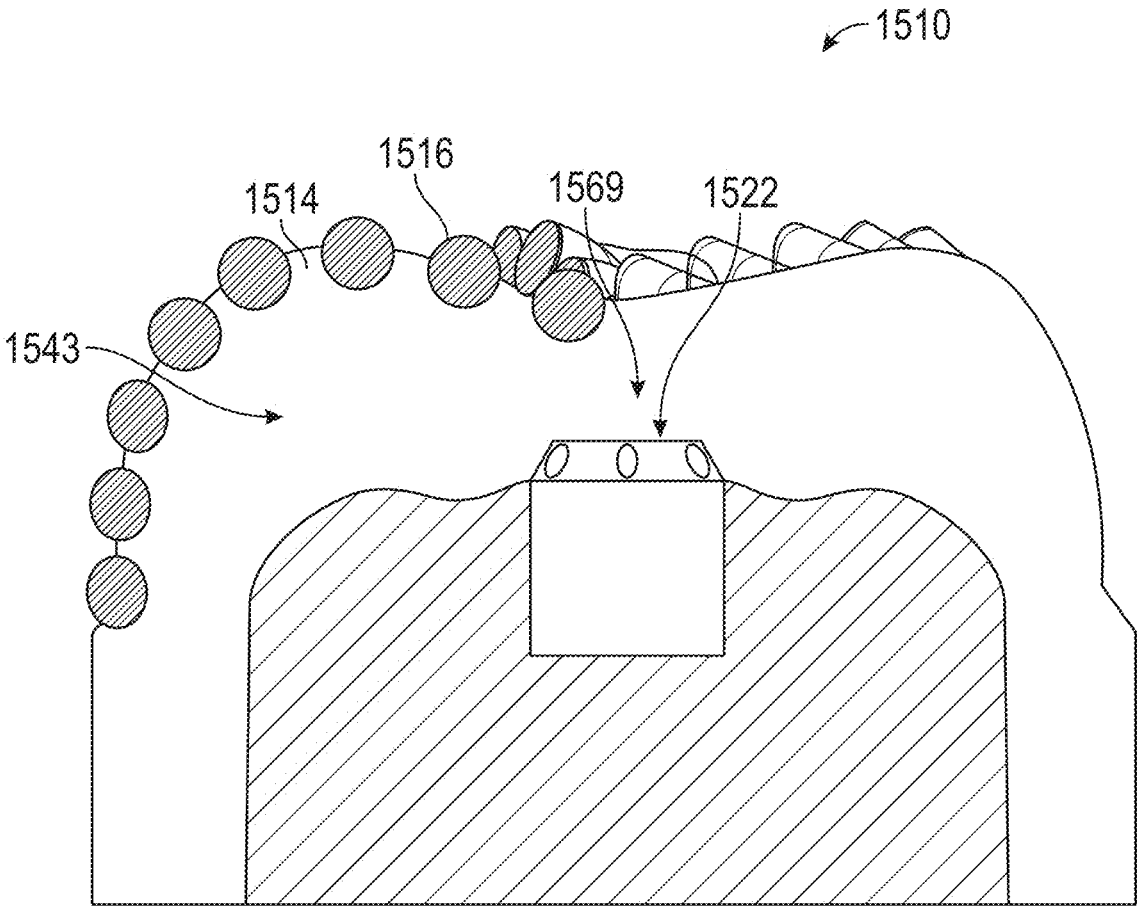
Figures 2, 15:
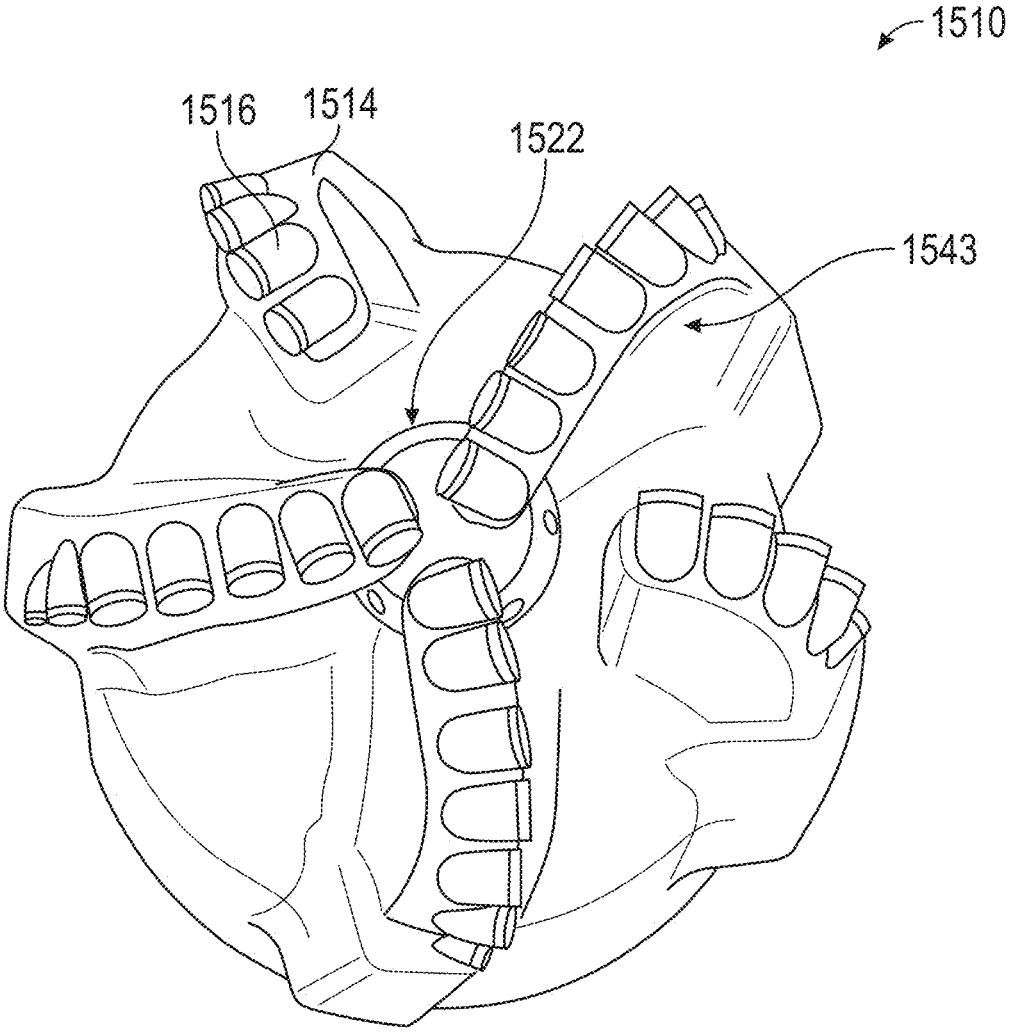

FIGS. 15-1 and 15-2 illustrate a representation of a cleaning element 1522 implemented in a downhole tool 1510, according to at least one embodiment of the present disclosure. The downhole tool 1510 may include one or more blades 1514 having one or more cutting elements 1516 disposed thereon. In some embodiments, two or more (or all) of the blades 1514 may overhang the cleaning element 1522. For example, as shown, a support structure 1543 of two or more of the blades 1514 may extend toward and over the cleaning element 1522 and may join or make contact over the cleaning element 1522 to form a bridge 1569. The blades 1514 may join to form the bridge 1569 at a central portion of the downhole tool 1510. The bridge 1569 may facilitate positioning one or more of the cutting elements 1516 such that they are close or substantially at the center of the downhole tool 1510 and such that the downhole tool 1510 may cut or remove an increased amount (or an entirety) of the bottom hole of the wellbore. The bridge 1569 may also help to protect the cleaning element 1522 by preventing or minimizing and engagement of the cleaning element 1522 with the formation.

In this way, a downhole tool may be implemented in various ways such that one or more features overhangs the cleaning element or cleaning cutting element to various degrees. This may facilitate implementing the cleaning/cleaning cutting element in a downhole tool. For example, the cleaning/cleaning cutting elements described herein may be positioned at a central portion of the downhole tool. Additionally, it may be advantageous to implement cleaning/cleaning cutting elements having a larger size (e.g., diameter) in order to achieve a larger offset for the offset flow features described above in order to direct the flow of drilling fluid at specific locations and/or features of the downhole tool. Thus, implementing the cleaning/cleaning cutting elements in a downhole tool may take up a valuable, and large space in the center of the downhole tool which may prevent other features (e.g., blade and/or cutting element) from being positioned in this central portion of the downhole tool. This may result in the downhole tool removing less material from the bottom hole and/or providing a less complete cut of the wellbore, specifically at the center of the downhole tool. Accordingly, a large core may develop at the center of the downhole tool which may be undesirable. By implementing one or more of the overhanging features described above, however, the blades and/or cutting elements may extend closer to the center of the downhole tool in order to more completely cut the bottom hole. In this way, the cleaning/cleaning cutting elements may be implemented (and even with a significantly large diameter) without compromising the functionality of the downhole tool to cut the bottom hole.

As described herein, in some embodiments, a cleaning element may be implemented in a downhole tool such that the cleaning element engages or contacts at least some of the formation as the downhole tool proceeds through the formation. For example, an implementation of a downhole tool may result in a formation core developing at a center of the downhole tool. In some embodiments, the formation core may gradually extend toward the cleaning element and may contact the cleaning element.

Figures 1, 16:
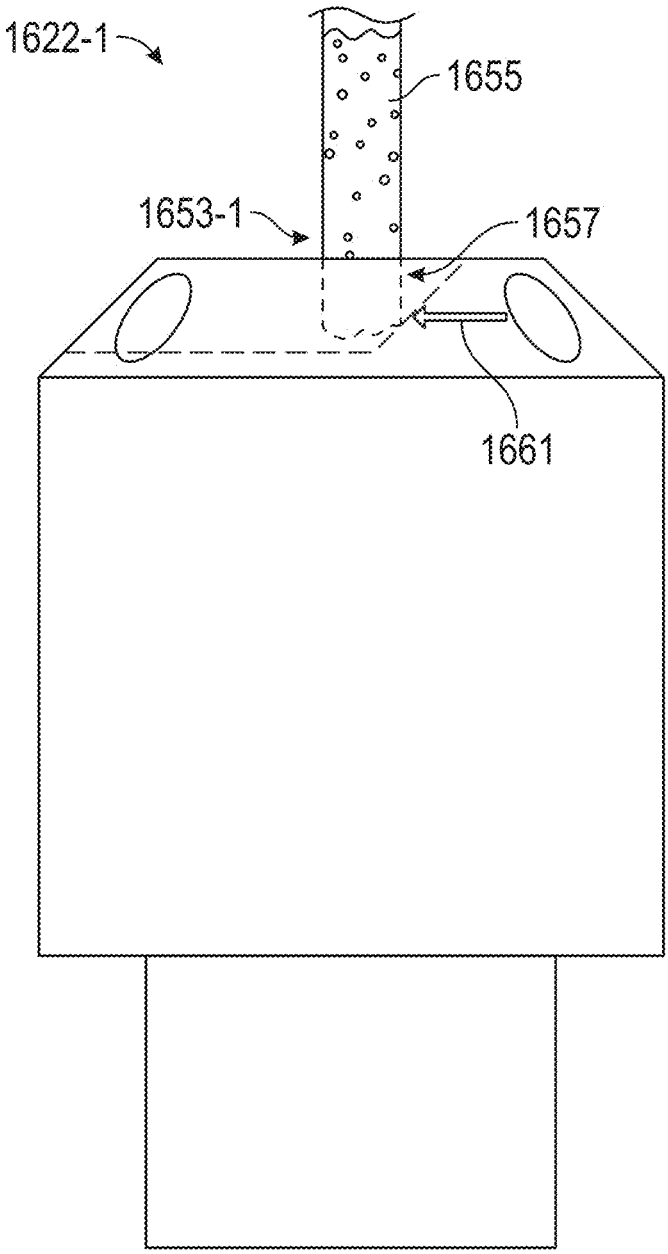
Figures 2, 16:
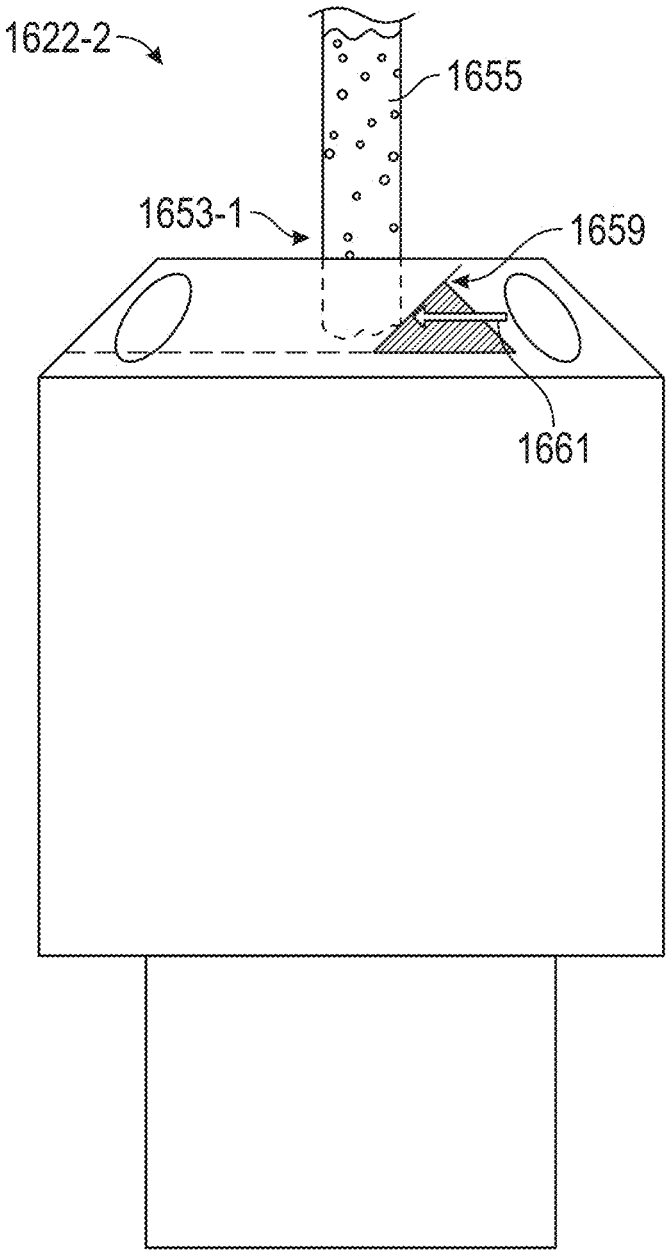

FIG. 16-1 illustrates a representation of a cleaning element 1622-1, according to at least one embodiment of the present disclosure. In some embodiments, the cleaning element 1622-1 includes a coring feature 1653-1. The coring feature 1653-1 may be positioned at or near a top of the cleaning element 1622-1 where a formation core 1655 may extend toward and engage the cleaning element 1622-1. The coring feature 1653-1 may include and/or may exhibit one or more sloped elements 1657 such that when the formation core 1655 engages the coring feature, the sloped element 1657 applies a side load or lateral force 1661 on the formation core 1655. This lateral force 1661 may cause the formation core 1655 to break, crack, or otherwise degrade such that some or all of the formation core 1655 is removed and carried away with other formation cuttings of the downhole tool. In this way, the formation core 1655 may be removed in order that the formation core 1655 may not exert or apply a significant axial or force (e.g., resulting from a weight on bit of the downhole tool) on the cleaning element 1622-1 which may damage and/or wear the cleaning element 1622-1.

In some embodiments, the coring feature 1653-1 may be implemented with one or more ultrahard components or layers in order that the coring feature 1653-1 may engage the formation core 1655 with an increased wear resistance. For example, the sloped element 1657 may be covered, layered, or may otherwise have an engagement surface that includes an ultrahard material such as a PCD joined thereto. FIG. 16-2 illustrates a representation of a cleaning element 1622-2, according to at least one embodiment of the present disclosure. The cleaning element 1622-2 may include an ultrahard element 1659. The ultrahard element 1659 may be include or exhibit a slope to apply a side load or lateral force 1661 to the formation core 1655 in order to break the formation core 1655. The ultrahard element 1659 may be offset from a center or central axis of the cleaning element 1622-1 such that the formation core 1655 may engage a sloped side of the ultrahard element 1659 to provide the lateral force 1661. In this way, implementations of a cleaning element described herein may include a coring feature in order to protect the cleaning element from a resulting formation core that may develop and contact the cleaning element. The coring feature may not be limited to just the implementations shown and described herein, but may include any feature for breaking, degrading, or removing the formation core.

It should be understood that the features of the various embodiments of the cleaning element, such as the mechanical connection of the cleaning element, the cleaning element being insertable from an inside a downhole tool, the direction being offset to provide non-divergent flows of drilling fluid, the downhole tool overhanging the cleaning element, etc., are not limited to implementation with just a (e.g., cutter-less) cleaning element, but, for example, may be applicable to a cleaning cutting element as discussed herein. In this way, one or more (or all) of the features and functionalities of the cleaning element(s) described herein and/or shown in the illustrative figures may be applicable to cleaning cutting elements having ultrahard engagement surfaces (e.g., cutting elements) disposed thereon.

Additionally, while the various downhole tools and bits described herein are shown and described as having one or more engagement faces that are implemented as engagement faces of associated cutting elements disposed on blades of the downhole tools, it should be understood that the downhole tools may include engagement (e.g., cutting) faces with or without implementing cutting elements. For example, in some embodiments, one or more blades of a downhole tool may include engagement face(s) thereon as part of the blade itself without having cutting elements disposed on the blade. In this way, the features and functionalities described herein of providing various flows of drilling fluid to the downhole tool may be applicable to blade both having engagement faces implemented with respect to cutting elements, and without.

The embodiments of the cleaning cutting elements have been primarily described with reference to wellbore drilling operations; the cleaning cutting elements described herein may be used in applications other than the drilling of a wellbore. In other embodiments, cleaning cutting elements, according to the present disclosure, may be used outside a wellbore or other downhole environment used for the exploration or production of natural resources. For instance, cleaning cutting elements of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole tool, comprising:

a body having a longitudinal axis and a fluid passage extending through the body;

at least one blade having one or more engagement faces thereon;

at least one junk slot extending adjacent to the at least one blade; and a single cleaning element positioned at and coaxially with the longitudinal axis of the body and having a substrate bore in fluid communication with the fluid passage, the single cleaning element including at least one opening of at least one fluid conduit for passing a fluid from the substrate bore and out of the downhole tool through the at least one junk slot, wherein the at least one fluid conduit is positioned at a radial conduit angle that extends between a conduit axis and a tangent line that is tangent to a circumferential wall of the substrate.

2. The downhole tool of claim 1, wherein the flow direction of the at least one opening is non-divergent to at least a portion of the one or more engagement faces.

3. The downhole tool of claim 2, wherein the portion is a radially inner portion of the one or more engagement faces.

4. The downhole tool of claim 1, wherein the flow direction of the fluid conduit is angled no more than 45° from a horizontal plane of the downhole tool.

5. The downhole tool of claim 1, wherein the cleaning element includes an ultrahard layer at an upper surface.

6. The downhole tool of claim 5, wherein cleaning element includes a coring feature for applying a side load to a formation core when the downhole tool is in operation.

7. The downhole tool of claim 1, wherein the downhole tool is a fixed-cutter drill bit.

8. The downhole tool of claim 1, wherein the at least one blade includes at least one cutting element connected thereto and the one or more engagement faces are one or more engagement faces of the at least one cutting element.

9. The downhole tool of claim 1, wherein the downhole tool includes a plurality of blades each having one or more engagement faces thereon, wherein a plurality of junk slots are formed between adjacent blades of the plurality of blades, and wherein the single cleaning element has a plurality of fluid conduits with respective openings for passing the fluid from the substrate bore and out of the downhole tool through the plurality of junk slots, each of the plurality of fluid conduits extends at a radial conduit angle that extends between a conduit axis of each of the plurality of fluid conduits and a tangent line that is tangent to the circumferential wall of the substrate.

10. The downhole tool of claim 9, wherein the flow direction of each of the plurality of openings is non-divergent to one of the plurality of blades.

11. The downhole tool of claim 1, wherein the cleaning element is removably connected to the body.

12. The downhole tool of claim 11, wherein the cleaning element is removably connected to the body at a cleaning element pocket of the downhole tool.

13. The downhole tool of claim 12, wherein the cleaning element pocket has an insertion direction from an outside surface of the downhole tool.

14. The downhole tool of claim 12, wherein the cleaning element pocket has an insertion direction from an inside surface of the downhole tool.

15. The downhole tool of claim 12, wherein the cleaning element is mechanically fastened to the cleaning element pocket.

16. The downhole tool of claim 1, wherein the cleaning element includes a seal between the cleaning element and the body for sealing the fluid from passing out of the fluid passage between the cleaning element and the body.

17. A downhole tool, comprising:

a body having a longitudinal axis and a fluid passage extending through the body;

at least one blade having one or more engagement faces thereon;

at least one junk slot extending adjacent to the at least one blade; and a cleaning element positioned at and coaxially with the longitudinal axis of the body, including:

a substrate bore in fluid communication with the fluid passage;

at least fluid conduit for passing a fluid from the substrate bore and out of the downhole tool through the at least one junk slot, wherein the at least one fluid conduit is positioned at a radial conduit angle that extends between a conduit axis and a tangent line that is tangent to a circumferential wall of the substrate;

a coring feature for applying a lateral force to a formation core to break the formation core; and wherein the at least one blade overhangs at least a portion of the cleaning element.

18. A downhole tool comprising:

a body having a longitudinal axis and a fluid passage extending through the body;

at least one blade having one or more engagement faces thereon, wherein the at least one blade has a curved shape;

at least one junk slot extending adjacent to the at least one blade; and a cleaning element positioned at and coaxially with the longitudinal axis of the body and having a substrate bore in fluid communication with the fluid passage, the cleaning element including at least one fluid conduit for passing a fluid from the substrate bore and out of the downhole tool through the at least one junk slot wherein the at least one fluid conduit is positioned at a radial conduit angle that extends between a conduit axis and a tangent line that is tangent to a circumferential wall of the substrate.

19. The downhole tool of claim 18, wherein the curved shape is a helical shape.

20. The downhole tool of claim 18, wherein the curved shape is in the direction of a rotation of the downhole tool.

21. The downhole tool of claim 20, wherein the fluid from the substrate bore has a flow in a direction that is convergent with the at least one blade.

22. The downhole tool of claim 18, wherein the curved shape is in the direction opposite a rotation of the downhole tool.

* * * * *